US007661799B2

(12) United States Patent
Kubo et al.

(10) Patent No.: US 7,661,799 B2
(45) Date of Patent: Feb. 16, 2010

(54) RECORDING APPARATUS AND METHOD FOR PRODUCING THE SAME

(75) Inventors: Tomoyuki Kubo, Nagoya (JP); Shigeru Suzuki, Nagoya (JP); Yasuhiro Kato, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 431 days.

(21) Appl. No.: 11/821,646

(22) Filed: Jun. 25, 2007

(65) Prior Publication Data

US 2007/0296763 A1 Dec. 27, 2007

(30) Foreign Application Priority Data

Jun. 27, 2006 (JP) ..... 2006-176399
Jun. 28, 2006 (JP) ..... 2006-178131
Jul. 11, 2006 (JP) ..... 2006-190254

(51) Int. Cl.
*B41J 2/05* (2006.01)

(52) U.S. Cl. ..... 347/58; 347/50

(58) Field of Classification Search ..... 347/20, 347/40–43, 48, 50, 58, 59, 85–87
See application file for complete search history.

(56) References Cited

U.S. PATENT DOCUMENTS 6,604,817 B2 8/2003 Isono et al.
7,004,565 B2 * 2/2006 Suzuki et al. ..... 347/50
2005/0253488 A1 11/2005 Ito

FOREIGN PATENT DOCUMENTS

JP 2001-246744 9/2001
JP 2004-098465 4/2004
JP 2005-313428 11/2005
JP 2005-322850 11/2005
JP 2006-177097 6/2006

* cited by examiner

*Primary Examiner*—Thinh H Nguyen
(74) *Attorney, Agent, or Firm*—Reed Smith LLP

(57) ABSTRACT

A circuit element which ensures an operation of a driving IC chip and a recording element, is mounted between a power supply and the driving IC chip of a flexible flat cable. Since the circuit element is arranged so as to avoid a bending portion of the flexible flat cable, even in a case of mounting the circuit element near the driving IC chip, it is possible to prevent the circuit elements from being peeled off, and to let the driving IC chip and the heat sink make a close contact assuredly.

31 Claims, 16 Drawing Sheets

RECORDING APPARATUS AND METHOD FOR PRODUCING THE SAME

CROSS REFERENCE TO RELATED APPLICATION

The present application claims priority from Japanese Patent Applications No. 2006-176399 filed on Jun. 27, 2006, No. 2006-178131 filed on Jun. 28, 2006 and No. 2006-190254 filed on Jul. 11, 2006, the disclosure of which are incorporated herein by reference in their entirety.

BACKGROUND OF THE INVENTION

1. Field of the Invention

The present invention relates to a recording apparatus which includes a flexible flat cable on which a driving IC chip is mounted, and a method for producing the recording apparatus.

2. Description of the Related Art

In Japanese Patent Laid-open No. 2004-98465 (FIGS. 6 and 7), a recording apparatus is described which includes a head-substrate and a body-substrate arranged inside an apparatus casing, a flexible flat cable which connects this body-substrate and the head-substrate, a recording head, a carriage on which the recording head is mounted and which performs scanning, another flexible cable which connects the recording head and the head-substrate, and a driver IC which outputs a drive pulse signal to these flexible flat cables.

When recording elements to be mounted on the recording head are arranged highly densely, it is necessary to make fine pattern wirings which are formed on the flexible flat cable connected to the recording head, and there is an increase a resistance of the pattern wiring. Therefore, the driving IC chip is mounted on the flexible flat cable such that the driving IC chip is positioned as close as possible to the recording head.

Moreover, when a plurality of recording elements is driven almost simultaneously, there is a fear of a voltage drop. Therefore, a condenser is arranged in a head-side circuit substrate on the carriage to compensate a voltage. However, since it is necessary to increase kinds of drive pulse signals for the recording head in order to realize a multi-gradation printing or the like, a control of the apparatus becomes diversified. Then the pattern wiring, which connects the driving IC chip and the head-side circuit substrate, also becomes minute (fine), and the IC chip may perform a malfunction due to an inductance component and a resistance component of the wiring pattern.

Furthermore, when a piezoelectric actuator is used as an actuator of the recording head, a piezoelectric material may be subjected to a polarization process with the flexible flat cable connected to the actuator. When the piezoelectric material is heated and cooled (returned to a room temperature), electric charges are generated in the piezoelectric material, and these electric charges may damage the circuit.

On the other hand, since the driving IC chip generates heat during a recording operation, the flexible flat cable is to be drawn around such that the driving IC chip and the heat sink are in a close contact.

Consequently, when the circuit element mentioned above is arranged near the driving IC chip of the flexible flat cable, there is a fear that the circuit element may contact with the heat sink. Due to the contact between the circuit element and the heat sink, the close contact between the driving IC chip and the heat sink may be inhibited, and there is a fear that the driving IC chip does not release the heat sufficiently.

SUMMARY OF THE INVENTION

The present invention is made to solve the abovementioned issues, and an object of the present invention is to realize a recording apparatus, and a method for producing the recording apparatus, the recording apparatus having a flexible flat cable on which the driving IC chip is mounted, being capable of preventing a malfunction of the driving IC chip and being capable of arranging the flexible flat cable favorably without affecting a circuit element for preventing the malfunction of the driving IC chip.

According to a first aspect of the present invention, there is provided a recording apparatus which performs a predetermined recording on a recording medium, including:

a recording head which includes a plurality of recording elements and an actuator having a plurality of driving portions which drive selectively the recording elements;

a head holder which holds the recording head such that the recording elements are exposed to an outside of the head holder;

a flexible flat cable bent to have a bent portion arranged in the head holder, and having a plurality of pattern wirings which are electrically connected to the driving portions of the actuator at one ends of the pattern wirings respectively;

a driving IC chip which is mounted on a surface of the flexible flat cable, and which is connected to the pattern wirings to supply a drive-voltage signal selectively to the driving portions of the actuator;

a power supply and a signal source which are connected to the other end of the pattern wirings to supply an electric current to the driving IC chip and the recording elements; and a circuit element which is electrically connected to a first portion, of the pattern wirings, between the driving IC chip and the power supply, which is mounted on the flexible flat cable at a different portion from the bent portion, and which supplies the electric current to the driving IC chip and the recording element.

According to the first aspect of the present invention, since the circuit element, which supplies the current to the driving IC chip and the recording element along with the power supply, is mounted on the flexible flat cable, between the driving IC chip and the power supply, even when a resistance of the pattern wirings increases due to the fine wiring in the flexible flat cable, it is possible to ensure an operation of the driving IC chip and the recording element. Moreover, even when the flexible flat cable is arranged by bending inside the head holder, it is possible to prevent the circuit element from being peeled off by a stress due to the bending of the flexible flat cable.

In the recording apparatus of the present invention, the driving IC chip may include a signal converting circuit which converts a signal transmitted from the signal source to a signal corresponding to the recording elements, and a drive-voltage signal generating circuit which generates a drive-voltage signal suitable for driving of the actuator based on the converted signal by the signal converting circuit, and the power supply may supply a current, for operating the signal converting circuit and the drive-voltage signal generating circuit, to the signal converting circuit and the drive-voltage signal generating circuit; and the circuit element may be electrically connected to a second portion, of the pattern wirings, between the drive-voltage signal generating circuit and the power supply, and may be mounted on the flexible flat cable.

In this case, the signal transmitted from the signal source is converted to a signal corresponding to a plurality of recording elements, and the drive-voltage signal suitable for driving of the actuator is generated based on the signal converted. The circuit element contributes to the generation of the drive-voltage signal. At this time, it is possible to prevent a malfunction in converting the signal corresponding to the plurality of recording elements.

In the recording apparatus of the present invention, the circuit element may include two elements, one of the elements being electrically connected to a third portion, of the pattern wirings, between the signal converting circuit and the power supply, and the other of the elements being electrically connected to the second portion, of the pattern wirings, between the drive-voltage signal generating circuit and the power supply; and the elements being mounted on the flexible flat cable. In this case, it is possible to prevent the malfunction in converting the signal corresponding to the plurality of recording elements.

In the recording apparatus of the present invention, the circuit element may be a condenser which is inserted in parallel between a pair of wires included in the pattern wirings, the pair of wires being electrically connected to the power supply.

In is case, since the condenser is inserted in parallel in the pattern wirings, it is possible to supply the necessary electric charges.

In the recording apparatus of the present invention, the actuator may be a piezoelectric actuator, and the circuit element may include an element which discharges electric charges generated by heating and cooling upon performing polarization process for the piezoelectric actuator.

In this case, since the circuit element includes an element which discharges the electric charges, it is possible to discharge safely the electric charges generated by heating and cooling when the polarization process is performed on the piezoelectric actuator, without having an effect on the driving IC chip.

The recording apparatus of the present invention, may further include a heat sink which is provided to the head holder, and which makes a heat conductive contact with the driving IC chip; and the flexible flat cable may be drawn along the heat sink, and the driving IC chip and the circuit element may be mounted at positions differing from the bent portion of the flexible flat cable.

In this case, since the flexible flat cable is drawn around by bending along the heat sink, it is possible to bring the driving IC chip in contact with the heat sink by bending the flexible flat cable. Therefore, it is possible to prevent the circuit element from being peeled off by the stress due to the bending of the flexible flat cable.

In the recording apparatus of the present invention, the head holder may have a base plate on a surface which faces the recording medium and on which the recording head is attached, a slit may be formed in the base plate to penetrate the base plate from the surface facing the recording medium to an opposite surface to the surface, and the flexible flat cable may be wired through the slit, and the heat sink may be provided on the opposite surface of the base plate; and the flexible flat cable may be bent at both sides of a position at which the driving IC chip makes a contact with the heat sink.

In this case, the recording head is installed on the base plate of the head holder, and the flexible flat cable is inserted through the slit and is bent in the vicinity of a position of contact with the heat sink. Accordingly, the circuit element can be arranged at a central position between the positions of bending of the flexible flat cable, and there is no hindrance to the bending arrangement of the flexible flat cable.

In the recording apparatus of the present invention, the heat sink may have a contact surface which makes a contact with a surface, of the driving IC chip, parallel to the flexible flat cable, and a guiding surface which guides the flexible flat cable to a side of a rear-surface of the head holder;

the flexible flat cable may have a first area drawn from the actuator to pass through the slit, a second area along the contact surface of the heat sink, and a third area along the guiding surface of the heat sink, and the first area, the second area, and the third area are defined by bending of the flexible flat cable;

the driving IC chip may be mounted at a substantially central position of the second area; and the circuit element may be mounted at a substantially central position between bending positions at which the flexible flat cable is bent.

In this case, the flexible flat cable is drawn from the actuator, and wired through the slit, and makes a contact with the heat sink, and is guided to a rear-surface side of the head holder along the guiding surface of the heat sink. Therefore, the circuit element is arranged at a center between the bending positions of the flexible flat cable, and there is no hindrance to the bending arrangement of the flexible flat cable.

In the recording apparatus of the present invention, the contact surface of the heat sink may be wide enough to cover the surface of the driving IC chip entirely; and the circuit element may be mounted on the surface of the flexible flat cable on which the driving IC chip is mounted, at a position at which the circuit element does not make a contact with the heat sink.

In this case, it is possible to arrange the circuit element without hindering the contact between the driving IC chip and the heat sink, and it is possible to release efficiently the heat generated from the driving IC chip, by the heat sink over a wide area.

In the recording apparatus of the present invention, the circuit element may be mounted on an opposite surface, of the flexible flat cable, opposite to the surface on which the driving IC chip is mounted.

In this case, since the circuit element is mounted on the opposite surface, of a flexible portion, opposite to the surface on which the driving IC chip is mounted, the circuit element is not projected on the surface of the flexible flat cable, on which the driving IC chip is mounted. Therefore, there is no possibility at all that the circuit element makes a contact with the heat sink, irrespective of the mounting height of the circuit element, and also the contact between the heat sink and driving IC chip is not inhibited. Therefore, it is possible to release assuredly the heat of the driving IC chip, by the heat sink.

The recording apparatus of the present invention may further include:

a heat sink which makes a heat conductive contact with the driving IC chip; and the circuit element may be mounted on the surface of the flexible flat cable on which the driving IC chip is mounted, and a height of the circuit element may be lower than that of the driving IC chip.

In this case, the circuit element is mounted on the surface, of the flexible flat cable, on which the driving IC chip is mounted, and a height of the circuit element is lower than that of the driving IC chip. Therefore, even when the heat sink is arranged such that the heat sink makes a contact with the driving IC chip, there is no possibility that the circuit element which is mounted near the driving IC chip makes a contact with the heat sink. Therefore, it is possible to release the heat of the driving IC chip by bringing the heat sink in a close contact assuredly, with the driving IC chip.

The recording apparatus of the present invention may further include a heat sink which makes a heat conductive contact with the driving IC chip; and the circuit element may be mounted on the surface of the flexible flat cable on which the driving IC chip is mounted, and a height of the circuit element may be higher than that of the driving IC chip; and a recess, which corresponds to the circuit element and which prevents the heat sink from contacting with the circuit element, may be formed in the heat sink.

In this case, since the recess for avoiding a contact with the circuit element is formed in the heat sink, corresponding to a circuit element higher than the driving IC chip, even when the circuit element is mounted near the driving IC chip, it is possible to release the heat of the driving IC chip by bringing the heat sink in a close contact assuredly, with the driving IC chip.

In the recording apparatus of the present invention, the heat sink may be arranged to face the circuit element, with a gap intervening between the heat sink and the head holder, and the flexible flat cable may be inserted through the gap.

In this case, since the flexible flat cable is inserted between the heat sink and the head holder holding the heat sink, the driving IC chip and the heat sink make a heat conductive contact. Therefore, it is possible to draw around the flexible flat cable without the circuit element hindering the contact.

The recording apparatus of the present invention may further include:

a heat sink which makes a heat conductive contact with the driving IC chip; and an elastic member in which a recess, which accommodates the circuit element, is formed at a position facing the circuit element and which presses the flexible flat cable, from a side opposite to the surface of the flexible flat cable on which the driving IC chip is mounted, to bring the driving IC chip in contact with the heat sink.

In this case, the driving IC chip and the circuit element are mounted on the surface on the opposite sides of the flexible flat cable respectively, and the recess is formed in the elastic member which presses the flexible flat cable from the side of the circuit element. Therefore, it is possible to release the heat of the driving IC chip by bringing the driving IC chip in contact with the heat sink assuredly, by the elastic member, without hindering the circuit element.

In the recording apparatus of the present invention, the heat sink may be arranged with a gap intervening between the heat sink and the head holder, and, the driving IC chip, the circuit element, and the elastic member may be arranged in the gap; and the driving IC chip may have a contact with the head holder to press the elastic member against the heat sink.

In this case, since the flexible flat cable is inserted between the heat sink and the head holder holding the heat sink, the driving IC chip and the heat sink make a heat conductive contact without hindering the circuit element.

In the recording apparatus of the present invention, the flexible flat cable may be arranged to bend toward the side of the surface on which the driving IC chip is mounted, at a position away from the driving IC chip;

the circuit element may be mounted on an opposite surface, of the flexible flat cable, opposite to the surface on which the driving IC chip is mounted, at an area between the driving IC chip and a bent portion at which the flexible flat cable is bent; and a projection which is projected toward the surface, of the flexible flat cable, on which the driving IC chip is mounted may be formed on the heat sink.

In this case, the projection, which is projected toward the opposite surface of the flexible flat cable on which the circuit element is provided at a position corresponding between the driving IC chip and the bending position, is provided on the heat sink. Therefore, further displacement of the flexible flat cable toward the bending side is restricted. Therefore, even when the flexible flat cable is bent along heat sink, the flexible flat cable is suppressed from being lifted up from the elastic member. Consequently, it is possible to press the elastic member uniformly against the entire surface of the driving IC chip, and to improve a heat releasing effect.

In the recording apparatus of the present invention, the head holder may include a first wall which makes a contact with the elastic member, and a second wall which is extended from the first wall in a predetermined angle;

the heat sink may include a surface facing the first wall and another surface facing the second wall;

the flexible flat cable may be wired to bend along the gap;

the circuit element may be mounted on an opposite surface of the flexible flat cable, opposite to the surface on which the driving IC chip is mounted, at an area between the driving IC chip and the bent portion; and a projection, which is projected toward the surface of the flexible flat cable on which the driving IC is mounted, may formed on the surface, of the heat sink, facing the first wall.

In this case, the flexible flat cable is bent almost along the boundary of the gap between the head holder and the heat sink. However, as the projection is provided on the heat sink, and the flexible flat cable is restricted from being displaced further toward the bending side, the flexible flat cable is suppressed from being lifted up from the elastic member. Moreover, since the elastic member is pressed uniformly against the entire driving IC chip, it is possible to improve the heat releasing effect.

According to a second aspect of the present invention, there is provided a method for producing a recording apparatus which perform a predetermined recording on a recording medium, the method including:

providing a recording head which includes a plurality of recording elements and an actuator having a plurality of driving portions which drive selectively the recording elements;

providing a head holder which holds the recording head such that the recording elements are exposed to an outside of the head holder;

providing a flexible flat cable bent to have a bent portion arranged in the head holder, and having a plurality of pattern wirings which are electrically connected to the driving portions of the actuator at one ends of the pattern wirings respectively;

providing a driving IC chip which is mounted on a surface of the flexible flat cable, and which is connected to the pattern wires to supply a drive-voltage signal selectively to the driving portions of the actuator;

providing a power supply and a signal source which are connected to the other ends of the pattern wirings to supply electric current to the driving IC chip and the recording elements;

providing a circuit element which supplies the electric current to the driving IC chip and the recording element;

mounting the circuit element on the flexible flat cable so as to avoid the bent portion; and connecting the circuit element electrically to a portion, of the pattern wirings, between the driving IC chip and the power supply.

According to the second aspect of the present invention, since the circuit element is mounted on the flexible flat cable so as to avoid the bending portion, it is possible to prevent the circuit element from being peeled off by a stress due to the bending of the flexible flat cable. Therefore, it is possible to mount the circuit element onto the flexible flat cable assuredly, and it is possible to enhance a production yield of the recording apparatus. Moreover, since the circuit element is connected to the portion, of the pattern wirings, between the driving IC chip and the power supply, even when a resistance of the pattern wirings increases due to the fine wiring in the flexible flat cable, it is possible to ensure an operation of the driving IC chip and the recording element.

DETAILED DESCRIPTION OF THE PREFERRED EMBODIMENTS

Figure 1:
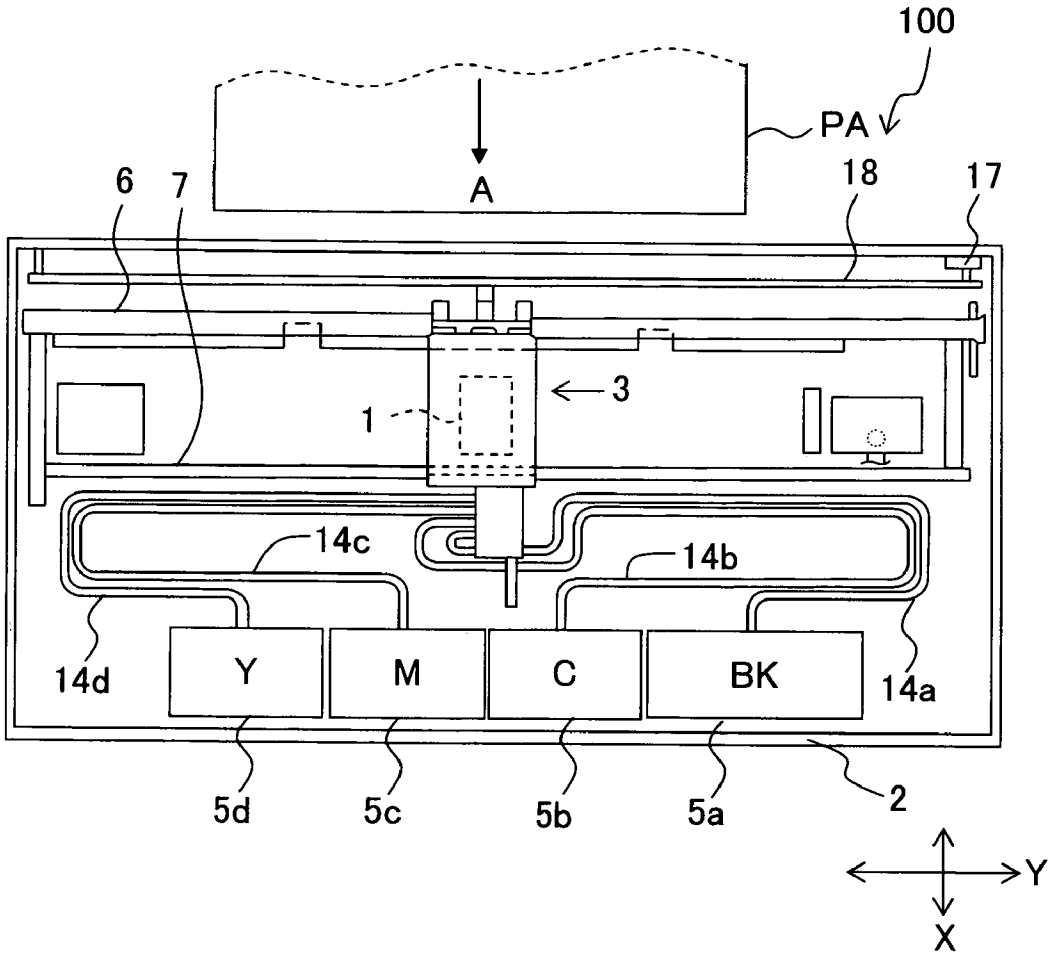
FIG. 1 is a plan view of an ink-jet recording apparatus of an embodiment (a first embodiment) of the present invention.

A first embodiment of the present invention will be described below. FIG. 1 shows an ink-jet recording apparatus 100 which corresponds to a recording apparatus according to the present invention. The ink-jet recording apparatus of the first embodiment is applicable to a printing apparatus which is provided with only a printer function, and a Multi Function Device (MFD) which is provided with functions such as a copier function, a scanner function, and a facsimile function. The ink-jet recording apparatus 100 includes a recording head 1, a frame 2, a carriage 3, two guide shafts (a rear guide shaft 6 and a front guide shaft 7), a carriage-driving motor 17, and a timing belt 18. The recording head 1 records an image or the like on a paper PA as a recording medium by jetting an ink on to the paper PA. The carriage 3 which is provided inside the frame 2 is mounted on the recording head 1, and runs along a main scanning direction (Y direction). The two guide shafts namely the rear guide shaft 6 and the front guide shaft 7, are provided in parallel along the main scanning direction. The carriage-driving motor 17 is arranged at a rear-right side of the frame 2. The timing belt 18 is an endless belt.

The carriage 3 is slidably mounted on the two guide shafts (the rear guide shaft 6 and the front guide shaft 7), and reciprocates in the main scanning direction (Y direction) due to the carriage-driving motor 17 and the timing belt 18. Moreover, the ink-jet recording apparatus 100 further includes a plurality of ink supply sources (ink tanks) 5*a*, 5*b*, 5*c*, and 5*d* located inside the frame 2, and ink supply tubes 14 (14*a*, 14*b*, 14*c*, and 14*d*) which connect the ink supply sources 5*a* to 5*d*, and the recording head 1. The ink is supplied from the ink supply sources 5*a* to 5*d* to the recording head 1 via the ink supply tubes 14 (14*a* to 14*d*). In the first embodiment, the ink supply sources 5*a* to 5*d* include a black ink (Bk), a cyan ink (C), a magenta ink (M), and a yellow ink (Y) respectively.

The paper PA is transported by a known paper transporting mechanism which is not shown in the diagram, in a state parallel to a lower-surface side of the recording head 1 toward an arrow A in FIG. 1, along a secondary scanning direction (X direction) orthogonal to the main scanning direction (Y direction). The recording is performed by jetting the ink downward from nozzles (not show in the diagram) which open in a lower surface of the recording head 1 moving in the main scanning direction. In this application, a surface, of the recording head 1, in which the opening of nozzles are formed is defined as a front surface or a lower surface, and another surface opposite to this surface is defined as a rear surface or an upper surface.

Figure 2:
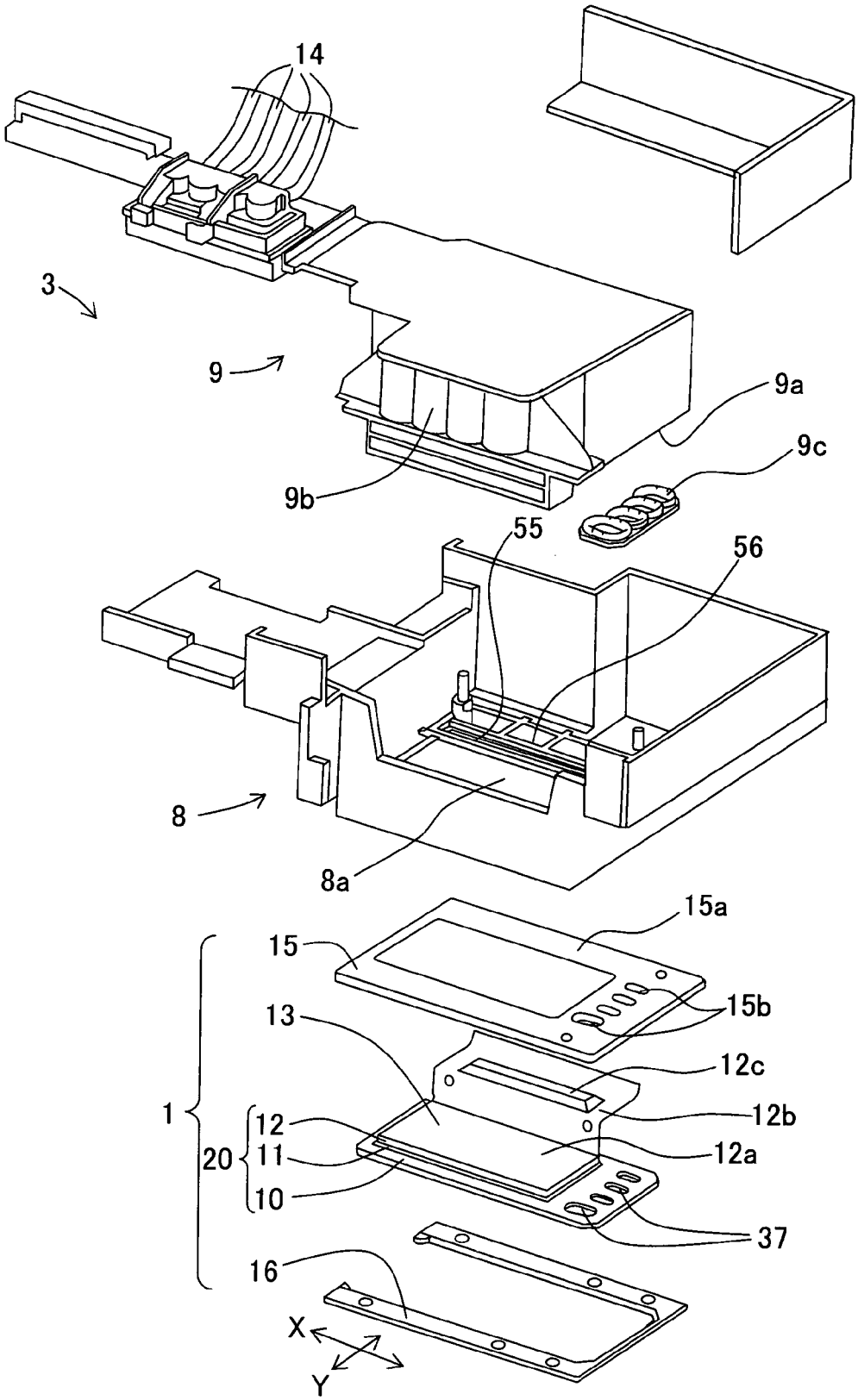
FIG. 2 is an exploded perspective view of a carriage.
Figure 3:
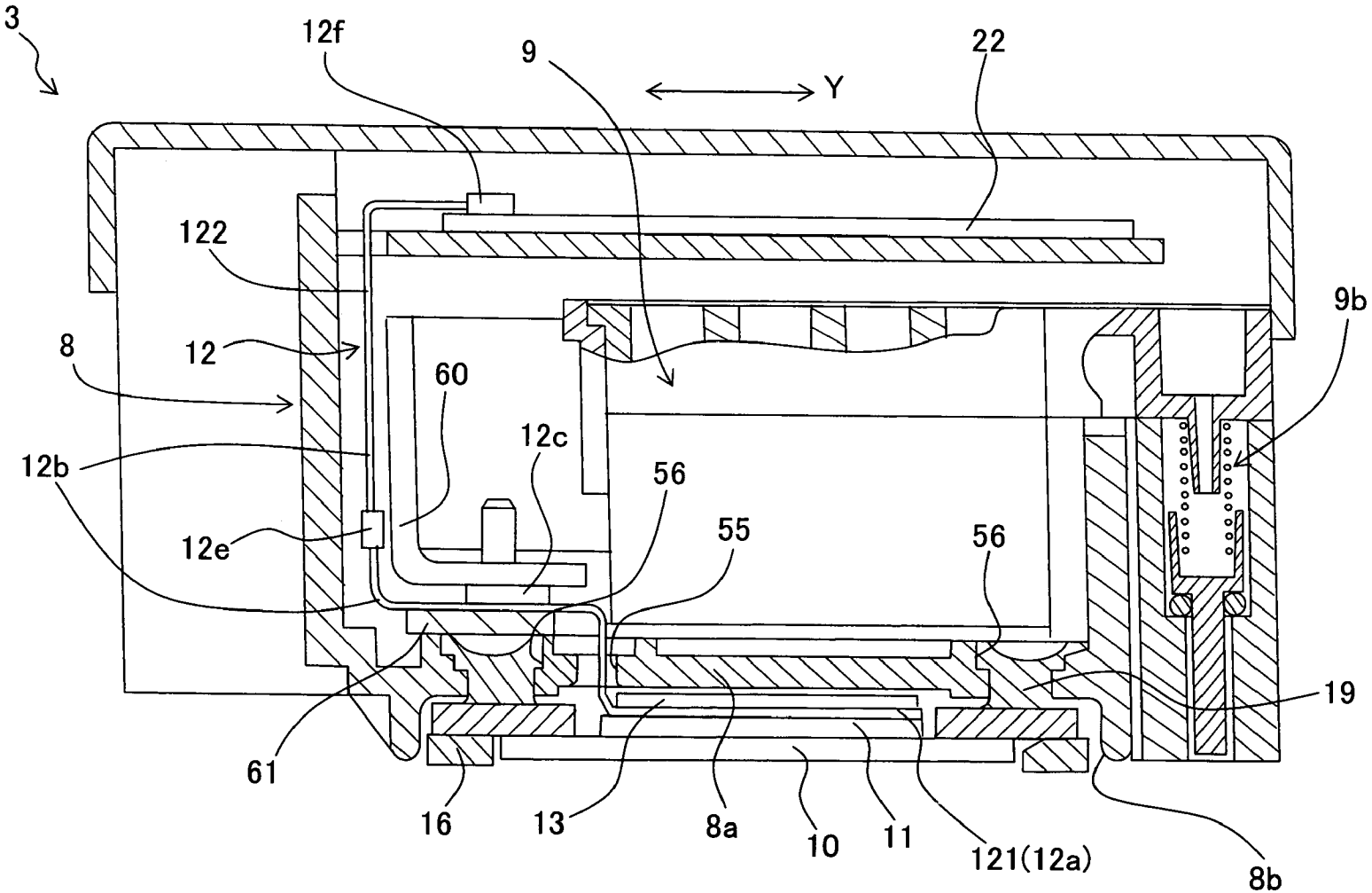
FIG. 3 is a cross-sectional view of a carriage shown in FIG. 1, taken along a line III-III.
Figure 4:
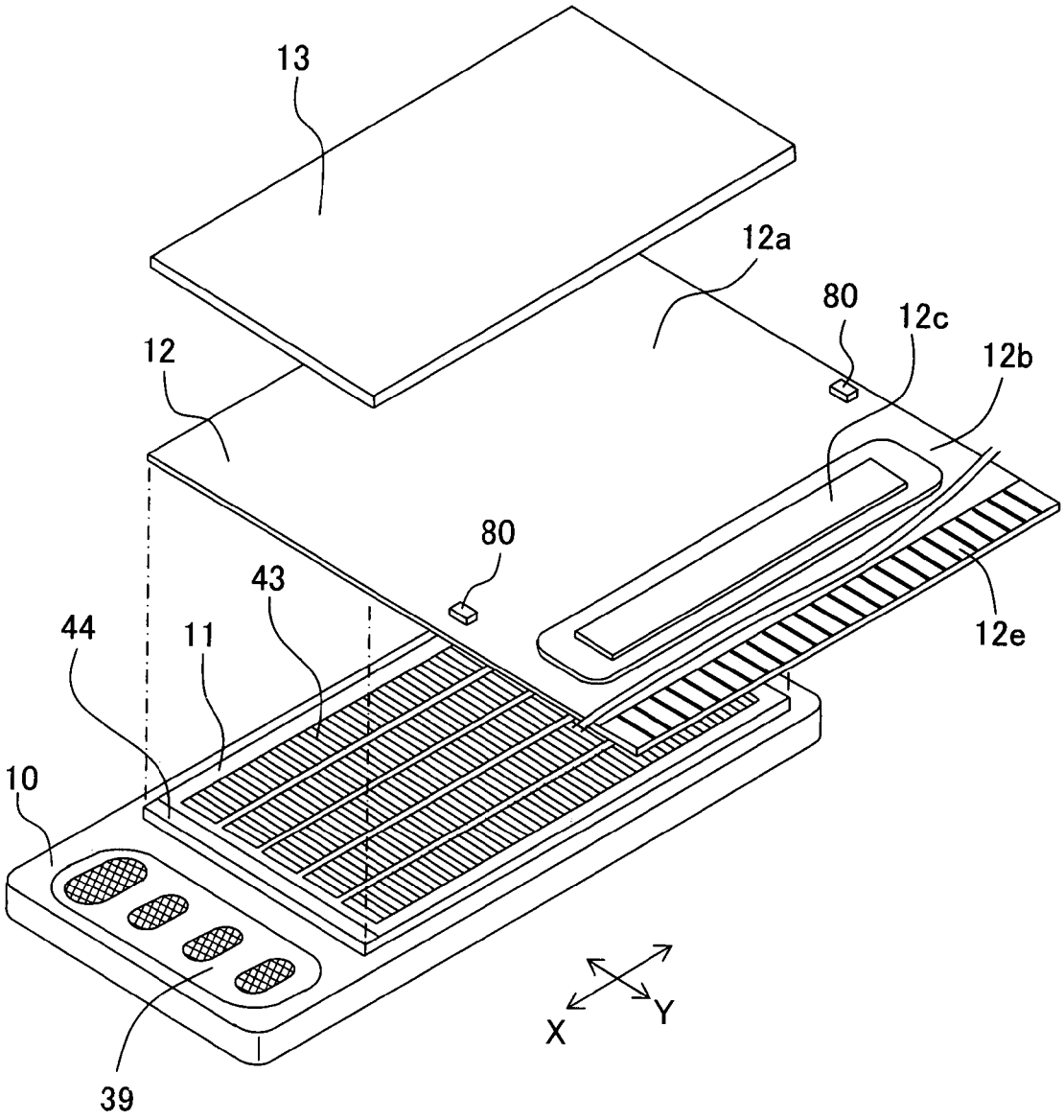
FIG. 4 is an exploded perspective view of a recording head.

As shown in FIG. 2, the carriage 3 includes a head holder 8 which is substantially box shaped. The head holder 8 includes a bottom plate (a base plate) 8*a*, and a recess 8*b* which is formed to have an aperture opening downwardly in a lower-surface side of the bottom plate 8*a*. As shown in FIG. 3, the recording head 1 is fixed to the head holder 8 such that the recording head 1 is almost parallel to the bottom plate 8*a* with the nozzles exposed in a downward direction.

A head-side circuit board 22 in which an electric circuit electrically connected to a body-side circuit board (not shown in the diagram) inside the frame 2 and the recording head 1 is formed, is arranged on a rear-surface side of the head holder. The head-side circuit board 22, when viewed from the rear-surface side of the head holder, is arranged at a position overlapping with the recording head 1.

A damper unit 9 which stores the ink to be supplied to the recording head 1 is mounted on an upper surface side of the bottom plate 8*a* of the head holder 8 between the recording head 1 and the head-side circuit board 22. The damper unit 9A is partitioned into a plurality of ink chambers, and an ink of a different color is stored in each of the ink chambers. The damper unit 9 includes an exhaust-valve mechanism 9*b* which removes air bubbles accumulated in the ink inside the ink chambers.

An aperture which is not shown in the diagram is formed through the bottom plate 8*a* of the head holder 8. As shown in FIG. 2, a plurality of ink outlet ports 9*a* of the damper unit 9 and a plurality of ink intake ports 37 of the recording head 1 are connected to the inside of the aperture via elastic seal members 9*c* and connecting holes 15*b* of a reinforcing frame 15 which will be described later. The ink is supplied independently for each color from the damper unit 9 to the recording head 1.

As shown in FIGS. 2 and 3, a slit 55 and a through hole 56 are formed in the bottom plate 8*a* of the head holder 8. A flexible portion 12*b* of the flexible flat cable 12 which is will be described later is inserted through the slit 55 from a front-surface side to a rear-surface side of the bottom plate 8*a*. The through hole 56 is for pouring in an adhesive 19 for fixing the recording head 1 to the front-surface side of the bottom plate 8*a*.

The recording head 1 includes a head unit 20, a heat conducting plate 13, the reinforcing frame 15, and a front frame 16. The head unit 20 includes a cavity unit 10 in which a plurality of ink channels are formed, and in a lower surface of which a plurality of nozzles are formed; a piezoelectric actuator 11 which applies selectively a jetting pressure to the ink in the cavity unit 11; and a flexible flat cable 12 which outputs a driving signal to the piezoelectric actuator 11. The cavity unit 10, the piezoelectric actuator 11, and the flexible flat cable 12 are arranged by stacking. The heat conducting plate 13 and the reinforcing frame 15 are arranged on a rear-surface side of the head unit 20. The front frame 16 surrounds an outer circumference of the head unit 20.

Similarly as in hitherto known cavity units in Japanese Patent Application Laid-open Nos. 2001-246744 and 2005-313428, in the cavity unit 10, an ink which is to be supplied individually to each of the ink intake ports 37 exposed on one-end side in X direction on an upper surface of the cavity unit 10, is distributed to a multiple number of pressure chambers through each manifold chamber. Moreover, by applying selectively the jetting pressure by driving of the drive section of the piezoelectric actuator 11, the ink is jetted from the nozzles communicating with the pressure chambers. In this application, the manifold chambers and the pressure chambers are not shown.

Similarly as in a hitherto known actuator disclosed in Japanese Patent Application Laid-open No. 2005-322850, the piezoelectric actuator 11 includes a plurality of ceramics layers which are stacked, and internal electrodes (not shown in the diagram) sandwiched between the ceramics layers. A plurality of drive portions (active portions) are formed in an area of the ceramics layer sandwiched between the internal electrodes.

The internal electrodes include a plurality of electrodes (individual internal electrodes) corresponding to the pressure chambers respectively, and electrodes (common internal electrodes) each of which is common for all pressure chambers. On an upper surface of the piezoelectric actuator 11, a plurality of external individual electrodes 43 which are electrically connected via the individual internal electrodes and through holes, and an external common electrode 44 which is connected to the common internal electrodes are formed. The active portion is displaced due to a drive pulse signal applied to the external individual electrode 43, and the jetting pressure is applied selectively to a desired pressure chamber among the pressure chambers. The external individual electrodes 43 are electrically connected to terminal electrodes 12*d* (refer to FIG. 6) individually, which are formed on the flexible flat cable 12. The external common electrode 44 is electrically connected to a common electric potential wire COM formed on the flexible flat cable 12.

The reinforcing frame 15 is a member which reinforces the cavity unit 10, and is made of a material (for example a metal such as stainless steel) having a stiffness superior to a stiffness of a material of the cavity unit 10. An outer shape (outer size) of the reinforcing frame 15 is slightly larger than the cavity unit 10. The reinforcing frame 15 is fixed upon stacking on a rear surface of the cavity unit 10, such that the reinforcing frame 15 surrounds the piezoelectric actuator 11. Therefore, a deformation or a distortion of the thin cavity unit 10 is prevented. A plurality of connecting holes 15*b* which correspond to the ink intake ports 37 of the cavity unit 10, is formed through at one-end side in X direction, of a frame portion 15*a* of the reinforcing frame 15.

Furthermore, the heat conducting plate 13 is stacked on a rear surface of the flexible flat cable 12, at a position corresponding to the piezoelectric actuator 11. The heat conducting plate 13 is a substantially rectangular shaped plate having a size sufficient to cover the surface of the piezoelectric actuator 11 entirely. The heat conductive plate 13 is formed of a material having a thermal conductivity superior to a thermal conductivity of the piezoelectric actuator 11 and the flexible flat cable 12, and a stiffness superior to a stiffness of the flexible flat cable 12, such as a metal like aluminum, copper, and stainless steel. A variation in a temperature distribution caused by dispersing the locally generated heat of the piezoelectric actuator 11 is suppressed by bringing the heat conducting plate 13 in a close contact with the piezoelectric actuator 11 via the flexible flat cable 12, and an effect of releasing the heat is shown. Furthermore, an effect of improving the stiffness of the head unit 20 as a whole is also shown. The heat conducting plate 13 is not required necessarily, and may be omitted.

As shown in FIGS. 2 and 3, the front frame 16 which is a plate member having a shape of an English alphabet U, is arranged to surround the cavity unit 10, and is fixed to a front surface of the reinforcing frame 15. A level difference (step) between a nozzle surface of the cavity unit 10 and an area surrounding the head holder 8 is eliminated by the front frame 16, and a wiper is prevented from being caught on the step in the nozzle surface at the time of cleaning the nozzle surface by the wiper.

The flexible flat cable 12 is in a form of a belt. The flexible flat cable 12 has a flat portion 12*a* at one-end side and a flexible portion 12*b* at the other-end side. The flat portion 12*a* is electrically connected to the external common electrode 44 and the external individual electrodes 43 of the piezoelectric actuator 11. The flexible portion 12*b* is connected to the flat portion 12*a*. A driving IC chip 12*c* which drives the piezoelectric actuator 11 is mounted on an upper surface of the flexible portion 12*b*. The head-side circuit board 22 and connecting terminals 12*f* are connected to one-end side of the flexible portion 12*b*.

It is also possible to form the flexible flat cable 12 by one continuous cable. However, in the first embodiment, the flexible flat cable 12 includes a first cable 121 and a second cable 122 connected by a connecting terminal 12*e*. The first cable 121 includes the terminal electrodes 12*d* which are electrically connected to the piezoelectric actuator 11, the common electric potential wire COM, and pattern wirings for connecting to the driving IC chip 12*c*. These wires are printed on an insulating film (non-conductive film). The second cable 122 is a general purpose cable having a plurality of parallel pattern wirings. The flat portion 12*a* overlapping with the piezoelectric actuator 11 is provided only to the first cable 121, and the flexible portion 12*b* is provided to both the first cable 121 and the second cable 122.

A plurality of the terminal electrodes 12 for electrically connecting to the piezoelectric actuator 11 is formed on a surface (lower surface), of the flat portion 12*a* of the flexible flat cable 12, facing the piezoelectric actuator 11. The driving IC chip 12*c* and a circuit element 80 such as a condenser and a resistor are mounted on an upper surface of the flexible portion 12*b* (on a surface opposite to a surface on which the terminal electrodes 12*d* are formed) of the flexible flat cable 12.

An elastic member 61 made of rubber, and a heat sink 60 facing the elastic member 61 are arranged on the rear-surface side of the bottom plate 8*a* of the head holder 8, at a position near one of side-plates. The driving IC chip 12 mounted on the flexible flat cable 12 is sandwiched between the elastic member 61 and the heat sink 60, parallel to the bottom plate 8*a*. In other words, a surface of the driving IC chip 12*c*, parallel to the flexible flat cable 12 is in a closely contact with the heat sink 60 in a heat-conductive manner.

The heat sink 60 is a metallic member and has a contact surface 60*a* which makes a close contact with the driving IC chip of the flexible flat cable 12, and a guiding surface 60*b* which guides the flexible flat cable 12 toward the head-side circuit board 22. The contact surface 60*a* is substantially parallel to the bottom plate 8*a*, and the guiding surface 60*b* is substantially parallel to a side wall of the head holder 8. The contact surface 60*a* and the guiding surface 60*b* are formed by bending such that the contact surface 60*a* and the guiding surface 60*b* are L-shaped in a side view. A width of the contact surface 60*a* is more than a width of the flexible flat cable 12 passing under the contact surface 60*a*, and is larger than an area of the driving IC chip 12*c*. Therefore, the contact surface 60*a* is capable of making a contact covering the entire surface of the driving IC chip 12*c*. Two cables which form the flexible flat cable 12, are connected at a position toward a lower end of the guiding surface 60*b* of the heat sink 60.

Figure 5:
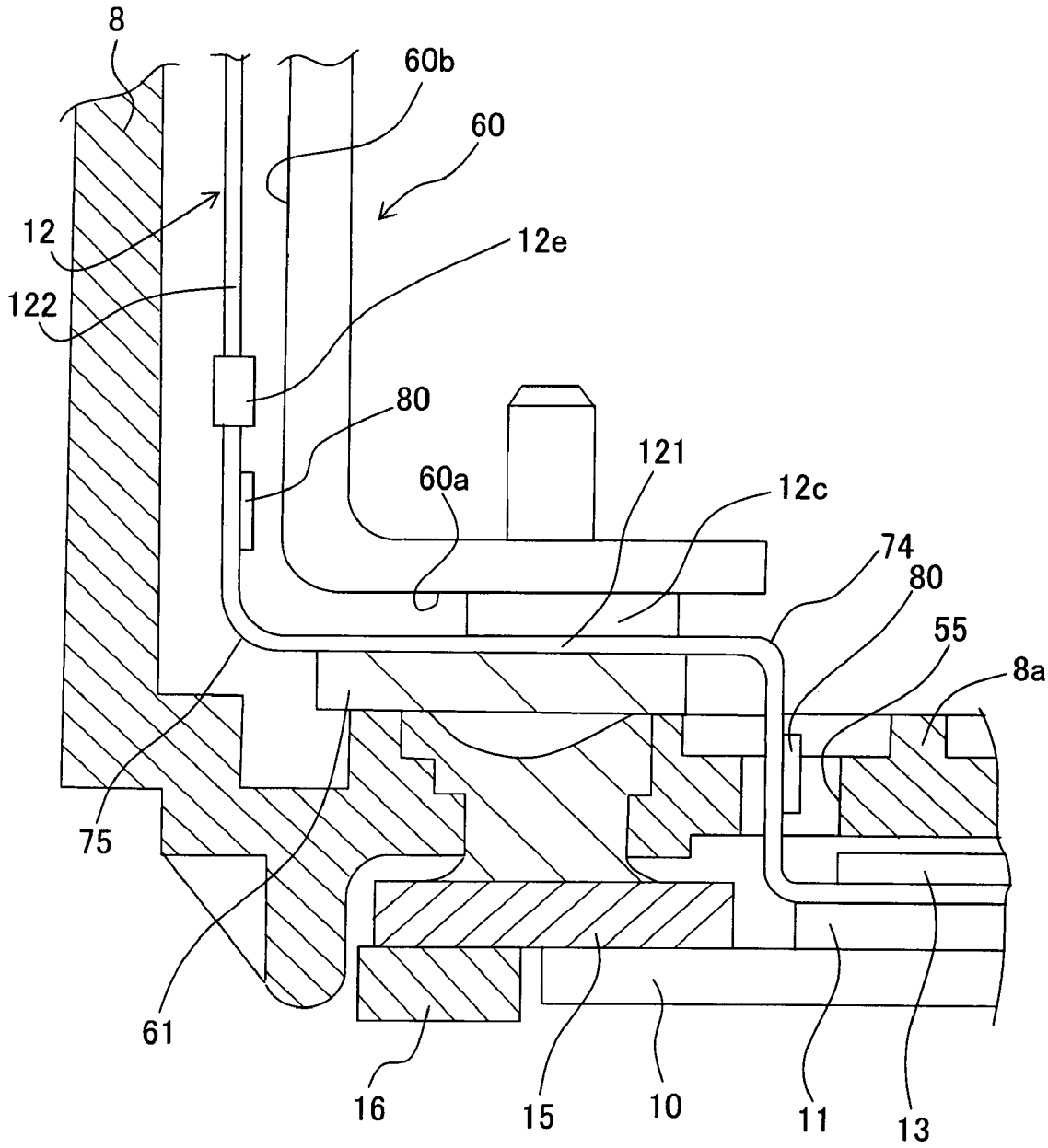
FIG. 5 is an enlarged cross-sectional view of an area near a heat sink and a circuit element.
Figure 6:
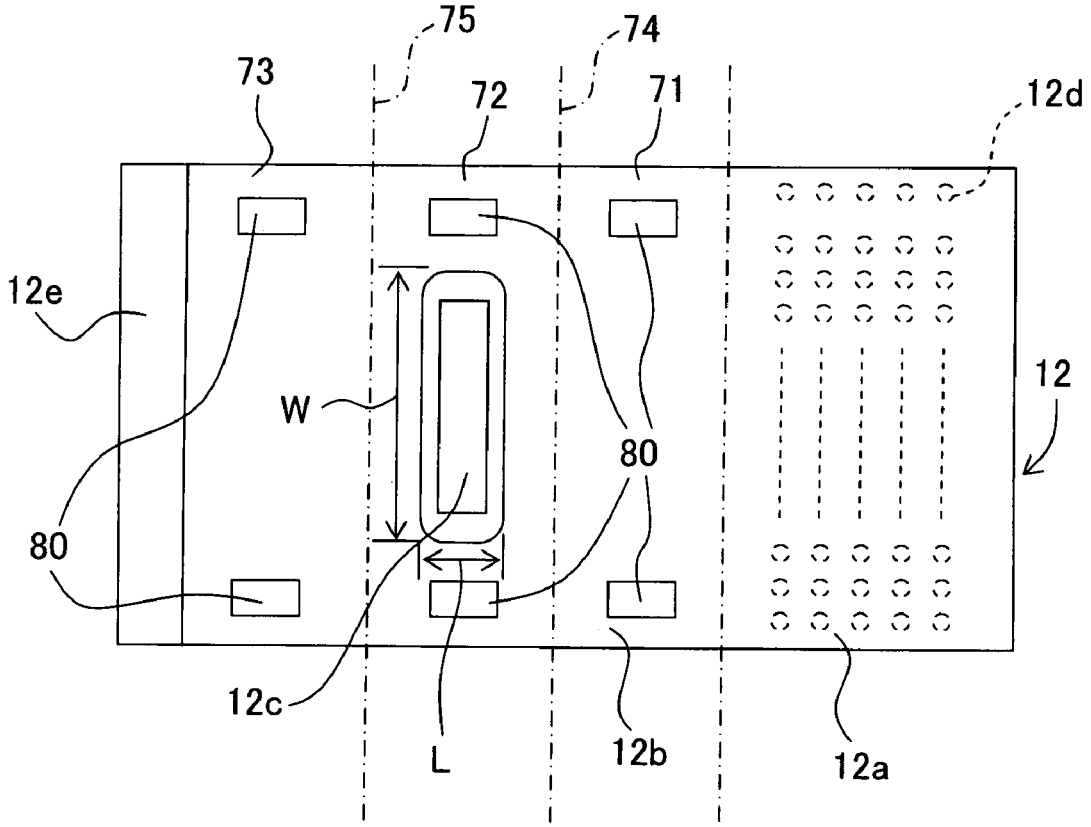
FIG. 6 is a development diagram of a flexible flat cable.

As described earlier, the flexible flat cable 12 is drawn from the actuator 11, and wired through the slit 55 in the bottom plate 8*a* of the head holder 8, and is drawn around the rear-surface side of the head holder 8 along the L-shape of the heat sink 60. In other words, for drawing around the flexible flat cable 12, the first cable 121 in the flexible flat cable 12 is bent twice in a form of steps. In other words, as shown in FIGS. 5 and 6, a first area 71, a second area 72 and a third area 73 are formed in the first cable 121, the first area being drawn from the piezoelectric actuator 11 for passing through the slit 55, the second area 72 being along the contact surface 60*a* of the heat sink 60, and the third area 73 being along the guiding surface 60*b* of the heat sink 60. The first and second areas 71, 72 are bordered by a first bending position 74, and the second and third areas 72, 73 are bordered by a second bending position 75. In the first embodiment, the third area 73 indicates an area from the second bending position 75 up to a trailing end (connecting terminal 12*e*) of the first cable 121.

As shown in FIG. 6, a length (mounting length) of the driving IC chip 12*c*, parallel to a longitudinal direction of the first cable 121 is L, a width (mounting width) of the driving IC chip 12 in a width direction orthogonal to the longitudinal direction of the first cable 121 is W. Here, the mounting width of the driving IC chip 12*c* is shorter than a width of the first cable 121. The driving IC chip 12*c* is mounted at a substantial center of the second area 72.

Figure 9:
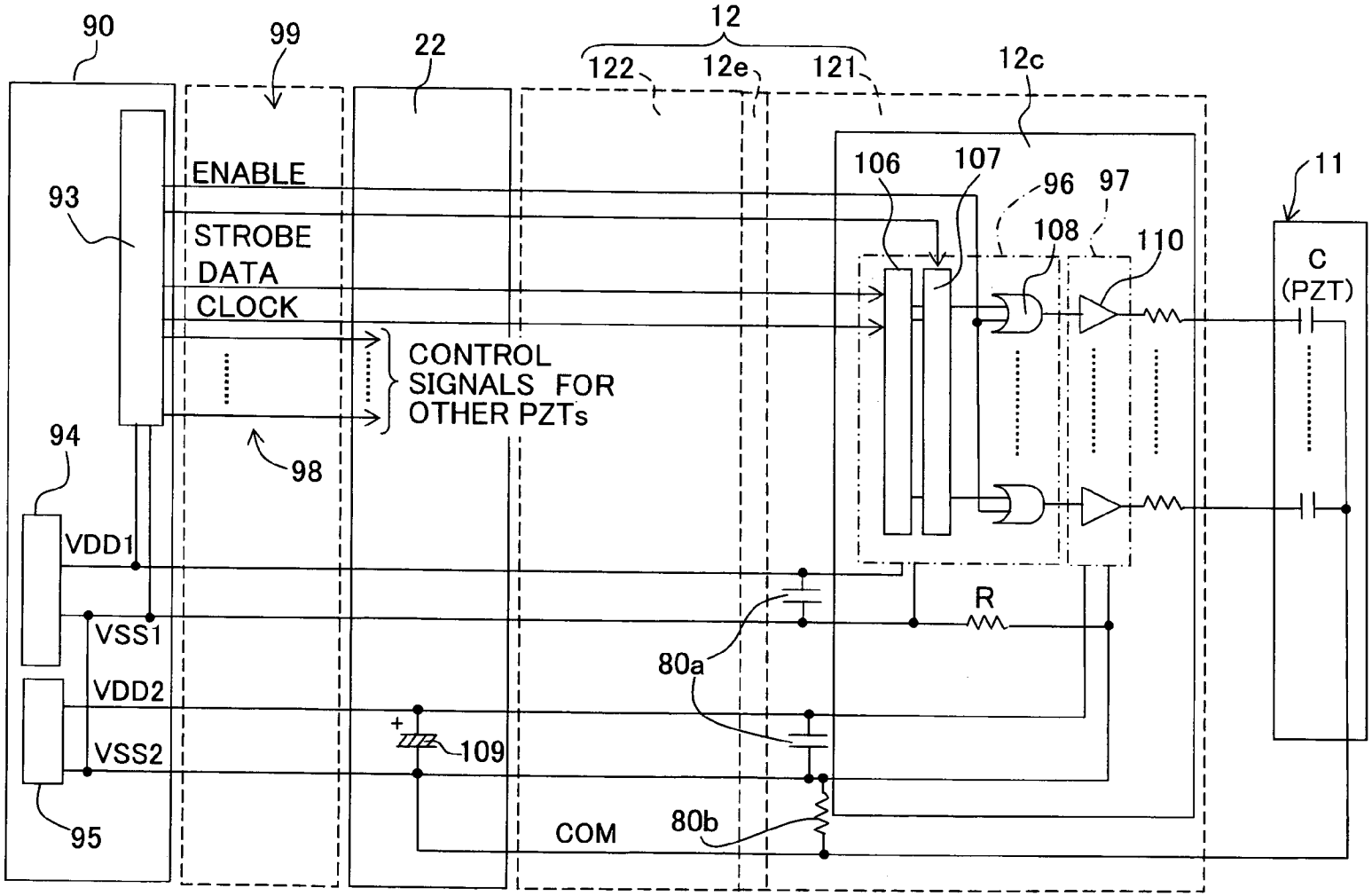
FIG. 9 is an electric-circuit diagram of the ink-jet recording apparatus.

FIG. 9 shows an example of an electric circuit which is applicable to the first embodiment. In the recording apparatus, a body-side circuit board 90, the head-side circuit board 22, the driving IC chip 12*c*, and the piezoelectric actuator 11 are connected mutually. A control circuit 93, a power supply for control signal 94, and a power supply for drive pulse 95 are mounted on the body-side circuit board 90. The driving IC chip 12*c* includes a signal converting circuit 96 and a drive-voltage signal generating circuit 97.

The control circuit 93 outputs control signals such as an enable signal, a data signal, a clock signal, and a strobe, and is connected to the signal converting circuit 96 via a control signal wire 98. The power supply for control signal 94 supplies a voltage (for example 5 volts) to the signal converting circuit 96, and is connected to the signal converting circuit 96 via a ground line VSS1 and a drive line VDD1 through which the drive voltage is applied. The power supply for drive pulse 95 supplies a voltage (for example 20 volts) to the drive-voltage signal generating circuit 97, and is connected to the drive-voltage signal generating circuit 97 via a ground line VSS2 and a drive line VDD2 through which the drive voltage is applied.

Concretely, the body-side circuit board 90 and the head-side circuit board 22 are connected via a flexible flat cable 99 in which the drive lines VDD1 and VDD2, the ground lines VSS1 and VSS2, and a control signal line 98 are arranged in the width direction. The driving IC chip 12*c* mounted on the first cable 121 and the head-side circuit board 22 are connected via the second cable 122 which includes each of the abovementioned wires and a common electric potential wire COM connected to the external common electrode 44 of the piezoelectric actuator 11.

On the head-side circuit board 22, an electrolytic capacitor (electrolytic condenser) 109 is connected to the drive line VDD2 and the ground line VSS2 as a bypass device, and electric charges to be supplied to the drive-voltage signal generating circuit 97 are accumulated. A voltage drop in the power supply for the drive pulse 95 when an instantaneous heavy (large) current flows through the drive-voltage signal generating circuit 97 is prevented. Moreover, the ground line VSS2 and the common electric potential wire COM connected to the external common electrode 44 of the piezoelectric actuator 11 are connected mutually. Since the ground line VSS2 and the ground line VSS1 are connected mutually via a resistor R on the first cable 121, or in the driving IC chip 12*c*, the drive-voltage signal generating circuit 97 and the signal converting circuit 96 are kept at the same electric potential.

The signal converting circuit 96 converts a control signal from the control circuit 93 to a control signal corresponding to each of the nozzles, and includes a shift resistor 106, a D flip flop (delay flip flop) 107, and a gate circuit 108. The number of these elements corresponds to the number of nozzles. Regarding the control signals transmitted from the control circuit 93 via the control signal wire 98, the data and clock signals are supplied to the shift resistor 106, the strobe signal is supplied to the D flip flop 107, and the enable signal is supplied to the gate circuit 108. The data is serially transferred from the control circuit 93, then converted to a parallel signal corresponding to a row of nozzles by the shift resistor 106, and is output from the D flip flop 107 synchronized with the strobe signal. Next, the enable signal (drive waveform signal) corresponding to the data is output from the gate circuit 108.

The drive-voltage signal generating circuit 97 converts the enable signal (drive waveform signal) output from the gate circuit 108 into a voltage signal for driving the piezoelectric actuator 11 based on the voltage supplied from the power supply for drive pulse 95, then generates as a drive pulse, and outputs. The drive-voltage signal generating circuit 97 has 150 pieces of drivers (driver circuits) 110 corresponding to the number of nozzles.

According to the recording apparatus having the structure described above, the voltage is supplied, from the power supply for control signal 94, to the signal converting circuit 96 via the drive line VDD1, and the signal converting circuit 96 is driven properly. On the other hand, the voltage is supplied, from the power supply for the drive pulse 95, to the drive-pulse generating circuit 97 via the drive line VDD2, and the electric charges are charged in the electrolytic capacitor 109 arranged at the drive line VDD2. At the time of ink jetting, an electric current is supplied from the electrolytic condenser 109 to the drive-pulse generating circuit 97 via the drive line VDD2, and a sufficient electric current is supplied to the piezoelectric actuator 11.

On the first cable 121, two condensers 80*a* and a resistor 80*b* are arranged as the circuit element 80 mounted near the driving IC chip. The condensers 80*a* are arranged, between the drive line VDD1 and the ground line VSS1 and between the drive line VDD2 and the ground line VSS2, to bypass these lines respectively. Moreover, the resistor 80*b* is connected between the common electric potential line (ground line) COM and the ground line VSS2.

Since the driver circuit 110 of the drive-voltage signal generating circuit 97 has a plurality of transistors for switching ON and OFF the piezoelectric actuator 11 and serially connected to an output line, transient current flows through the ground line VSS2 when the piezoelectric actuator 11 turns ON. Presumptively, when the condenser 80*a* is not arranged in the line, a comparatively high voltage is generated in the ground line VSS2 due to a resistance component and an inductance component of the flexible flat cable 12. At this time, since the resistor R of a low resistance is connected between the ground line VSS1 and the ground line VSS2, when there is an increase in the voltage of the ground line VSS2, the voltage of the ground line VSS1 is also increased. Then a relative voltage relationship with the control signal such as the data in the signal converting circuit 96 is disturbed. Due to this, the control signal could not be accepted properly, and this results in a malfunction. However, when the condenser 80*a* is mounted near the driving IC chip 12*c*, an electric current charged at the time of driving the piezoelectric actuator is supplied from the condenser 80*a*. Therefore, the rise in voltage of the ground lines VSS2 and VSS1 can be suppressed to be small, and it is possible to prevent the malfunction in identification of the control signal.

On the other hand, at the time of performing a polarization process on a piezoelectric material of the piezoelectric actuator 11 during a manufacturing process, when the piezoelectric material is heated or cooled, electric charges are generated. When these electric charges are made to short between the common electric potential line COM and the driving IC chip 12*c* or the control signal, a heavy current flows and the driving IC chip 12*c* may be damaged. Consequently, the abovementioned electric charges are discharged upon passing through the resistor 8*b* by mounting the resistor 80*b* near the driving IC chip 12*c*, and it is possible to prevent the driving IC chip 12*c* from getting damaged.

In this manner, since the condensers 80*a* and the resistor 80*b* are mounted near the driving IC chip 12*c*, on the flexible flat cable 12, the effect as described above is exhibited. FIG. 6 shows a concrete mode of arrangement thereof.

Practically, the drive lines VDD1 and VDD2, the ground lines VSS1 and VSS2, and the common electric potential line COM, are formed symmetrically along both side edges parallel to a direction of drawing on the piezoelectric actuator, on the first cable 121. Therefore, as shown in FIG. 6, the circuit element 80 is also mounted at a position along the both side edges. Moreover, in FIG. 6, the circuit elements 80 are arranged at the piezoelectric actuator side (side of an end portion on which the terminal electrodes 12*d* are formed), farther away from the driving IC chip of the first cable, or also arranged at an extension in the direction of width W of the driving IC chip 12*c*. This is realized by drawing around each of the abovementioned wires toward the piezoelectric actuator side farther away from the driving IC chip 12*c*, on the first cable 121.

One circuit element 80 or a plurality of circuit elements 80 is/are mounted on the first cable 121, corresponding to the driving IC chip 12*c* and the wires connected to the driving IC chip 12*c*. However, each circuit element 80 is mounted at a position not overlapping with the driving IC chip 12*c*, and avoiding the first bending position 74 and the second bending position 75.

It is desirable that each of the circuit elements 80 is mounted at a substantially central position in a longitudinal direction of the first cable 121, in each of the first area 71, the second area 72, and the third area 73 as shown in FIG. 6. Accordingly, it is possible to prevent a mounting portion (metal exposed portion such as a land) formed on the first cable 121 for mounting the element 80 from being subjected to a stress due to bending of the first bending position 73 and the second bending position 74 of the first cable 121.

Figure 7:
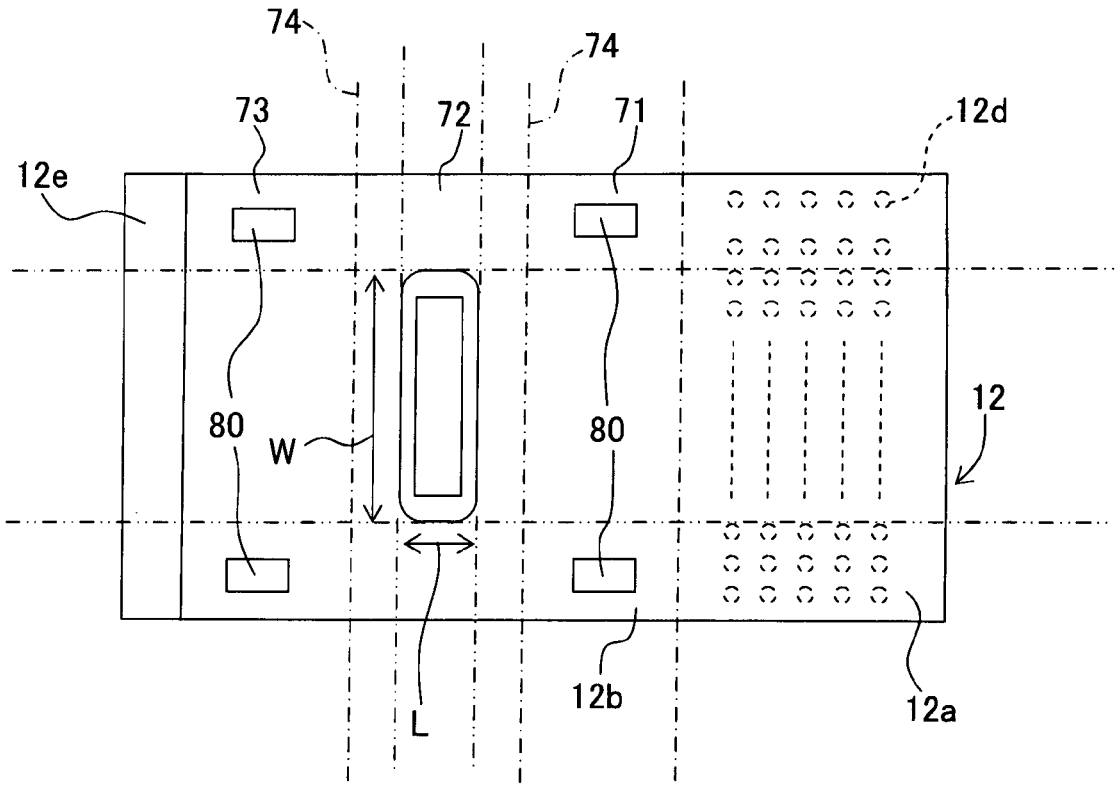
FIG. 7 is a development diagram of another example of the flexible flat cable.

Furthermore, it is desirable to avoid mounting the circuit element 80 on an area of the first area 71, the second area 72, and the third area 73, in which the mounting width W of the driving IC chip 12*c* is extended in the longitudinal direction (Y direction), and an area of the first area 71, the second area 72, and the third area 73, in which the mounting length L of the driving IC chip 12*c* is extended in the direction of width (X direction), as shown by alternate long and two short dashes lines in FIG. 7. Presumptively, when a circuit element 80 higher (thicker) than the driving IC chip 12*c* is mounted on these areas, there is a possibility that the circuit element 80 makes a contact with the heat sink 60 having the contact surface 60*a* which covers the driving IC chip 12*c* entirely.

Consequently, since the circuit element 80 is not mounted on the area in which the mounting width W of the driving IC chip 12*c* is extended in the longitudinal direction (Y direction), and the area in which the mounting length L of the driving IC chip 12*c* is extended in the direction of width (X direction), the contact surface 60*a* of the heat sink 60 and the driving IC chip 12*c* can be closely contacted to release assuredly the heat of the driving IC chip 12*c*.

Figure 8:
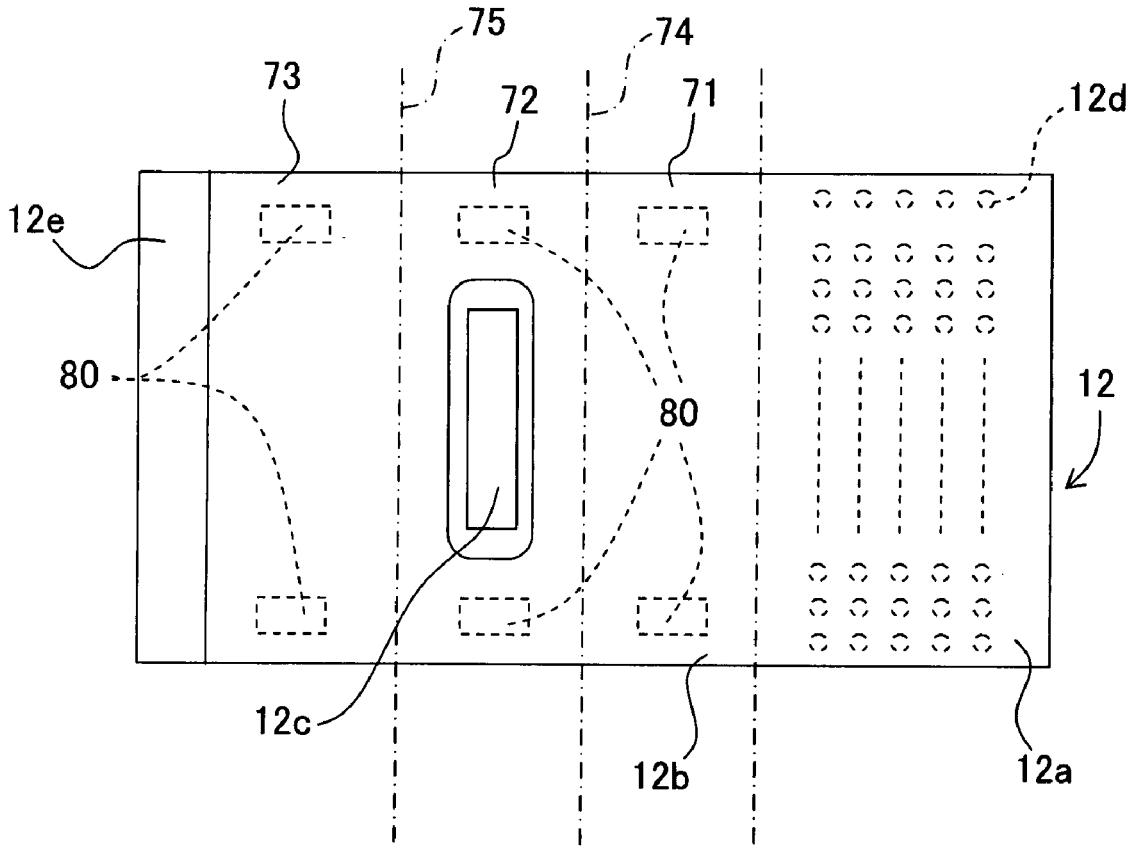
FIG. 8 is a development diagram of still another example of the flexible flat cable.

Moreover, as shown in FIG. 8, all the circuit elements 80 may be mounted on a surface of the flexible flat cable 12, on an opposite side of the surface on which the driving IC chip 12*c* is mounted. In this case, the circuit elements 80 may be mounted on an area overlapping upon sandwiching the flexible flat cable 12 and the driving IC chip 12*c*.

It is needless to mention that the arrangements of the circuit elements 80 shown in FIG. 6 to FIG. 8 may be combined, and the arrangement of the circuit elements 80 may be modified appropriately according to whether or not there is a through portion in or a flat shape of the flexible flat cable 12.

Figure 10:
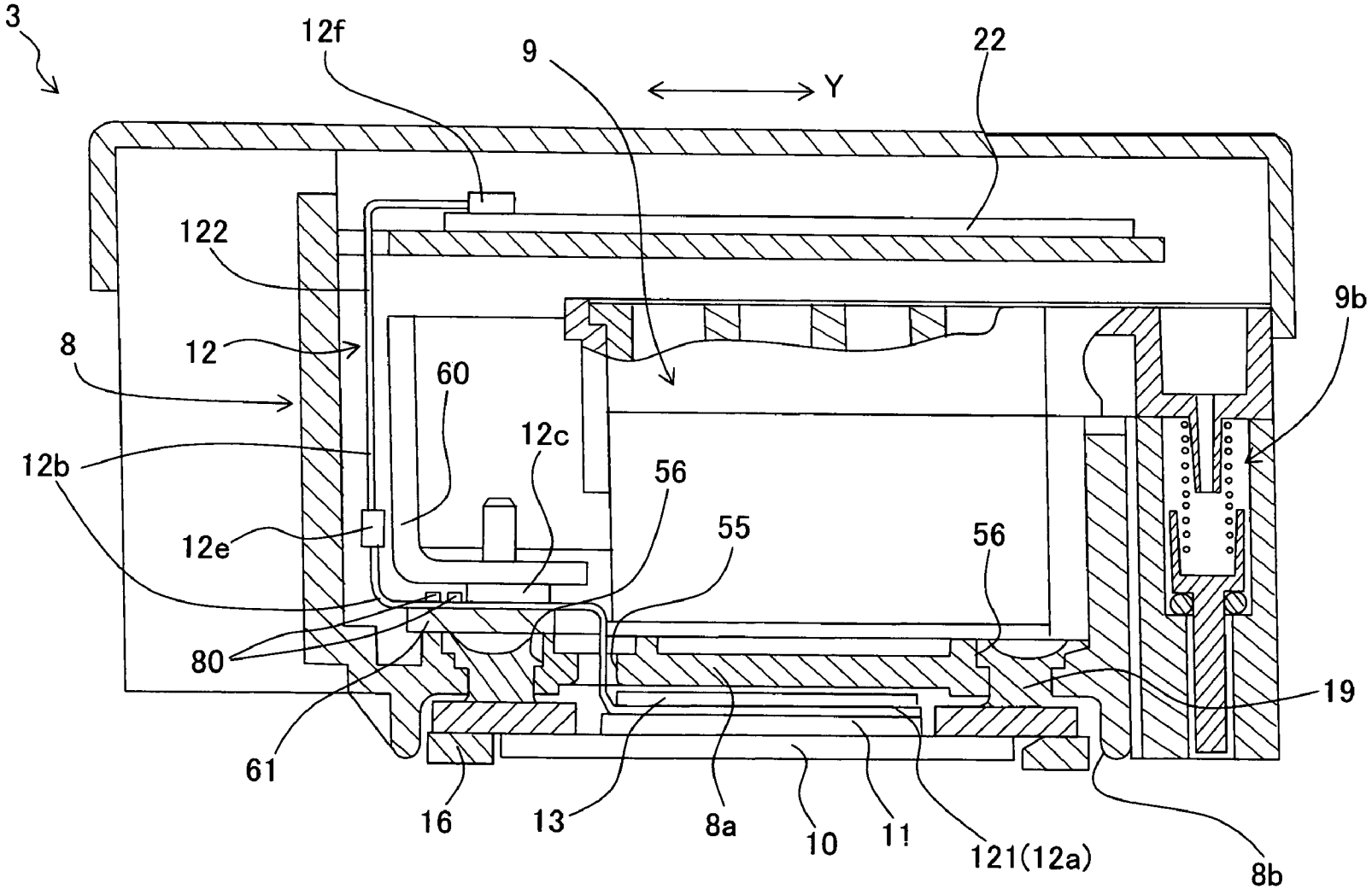
FIG. 10 is a diagram corresponding to FIG. 3 according a second embodiment.
Figure 11:
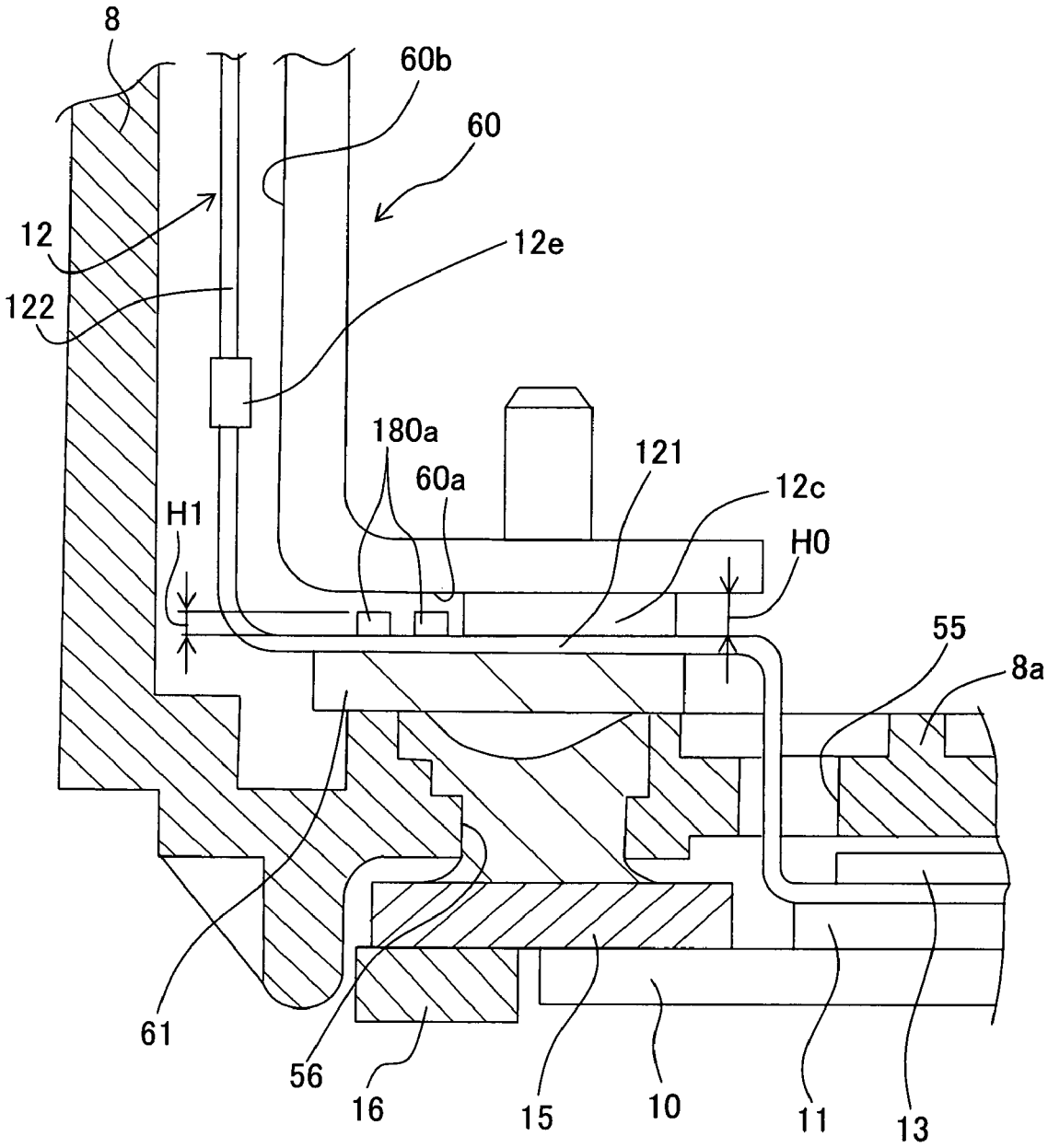
FIG. 11 is a diagram corresponding to FIG. 5 according to the second embodiment.

Next, a second embodiment of the recording apparatus according to the present invention will be described below. A recording apparatus of the second embodiment is structured similarly as the recording apparatus of the first embodiment, except for the flexible flat cable 12, and the heat sink 60. Therefore, a description of a portion excluding the flexible flat cable and the heat sink will be omitted. As shown in FIGS. 10 and 11, in the second embodiment, a height H1 of a circuit element 180*a* is higher than a height H0 of the driving IC chip 12*c*. Here, the heights H0 and H1 are measured from a surface of the flexible flat cable 12 (mounting height). In other words, as the circuit element 180*a* arranged facing the contact surface 60*a*, near the driving IC chip 12*c*, a component having a mounting height less than H0 is selected.

Even when the circuit element 180*a* is arranged near the driving IC chip 12*c*, this circuit element 180*a* does not make a contact with the heat sink 60. Therefore, there is no fear that the close contact between the contact surface 60*a* and the driving IC chip 12*c* is hindered, and it is possible to prevent a malfunction by releasing assuredly the heat of the driving IC chip 12*c*. In addition, the contact surface 60*a* may be let to make a close contact with the driving IC chip 12*c*, and for this only a flat surface may be formed. Consequently, a processing (machining) of the contact surface 60*a* of the heat sink 60 becomes easy, and it is possible to facilitate a reduction of a processing cost.

Figure 12:
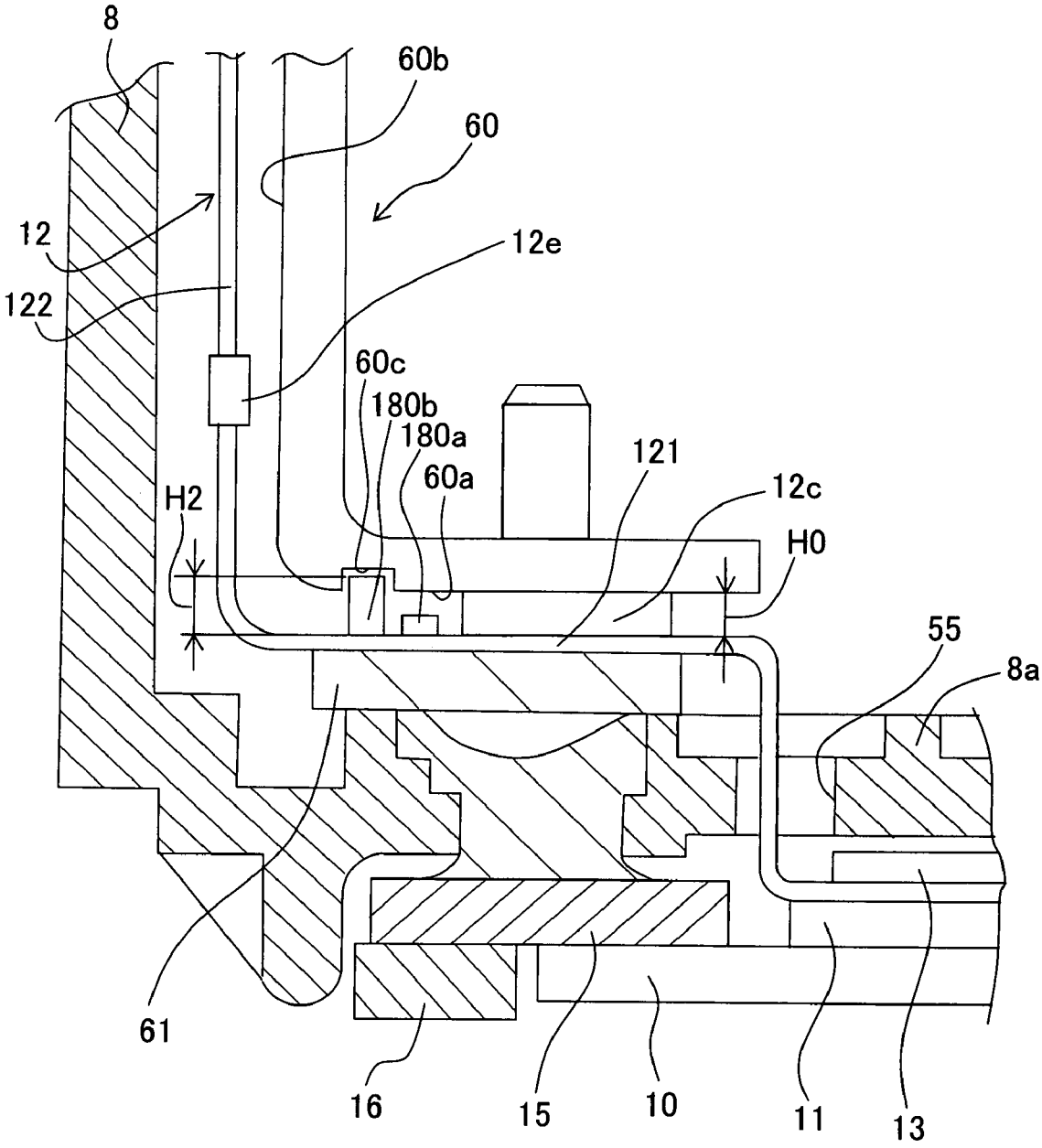
FIG. 12 is a diagram corresponding to FIG. 5 according to another example of the second embodiment.

As shown in FIG. 12, when a mounting height H2 of the circuit element 180*b* arranged at a position facing the contact surface 60*a* of the heat sink 60 is higher than the mounting height H0 of the driving IC chip 12*c*, it is possible to avoid the contact with the circuit element 180*b* by forming a recess 60*c* in the contact surface 60*a*.

Accordingly, it is possible to select freely the circuit element 180*a*, 180*b* without the mounting height of the driving IC chip being restricted, while maintaining the close contact of the contact surface 60*a* and the driving IC chip 12*c*. Furthermore, since it is possible to select a large circuit element 180, it is possible to reduce the number of components of the circuit element 180*a*, 180*b*, and to facilitate the reduction in the cost of components.

Figure 13:
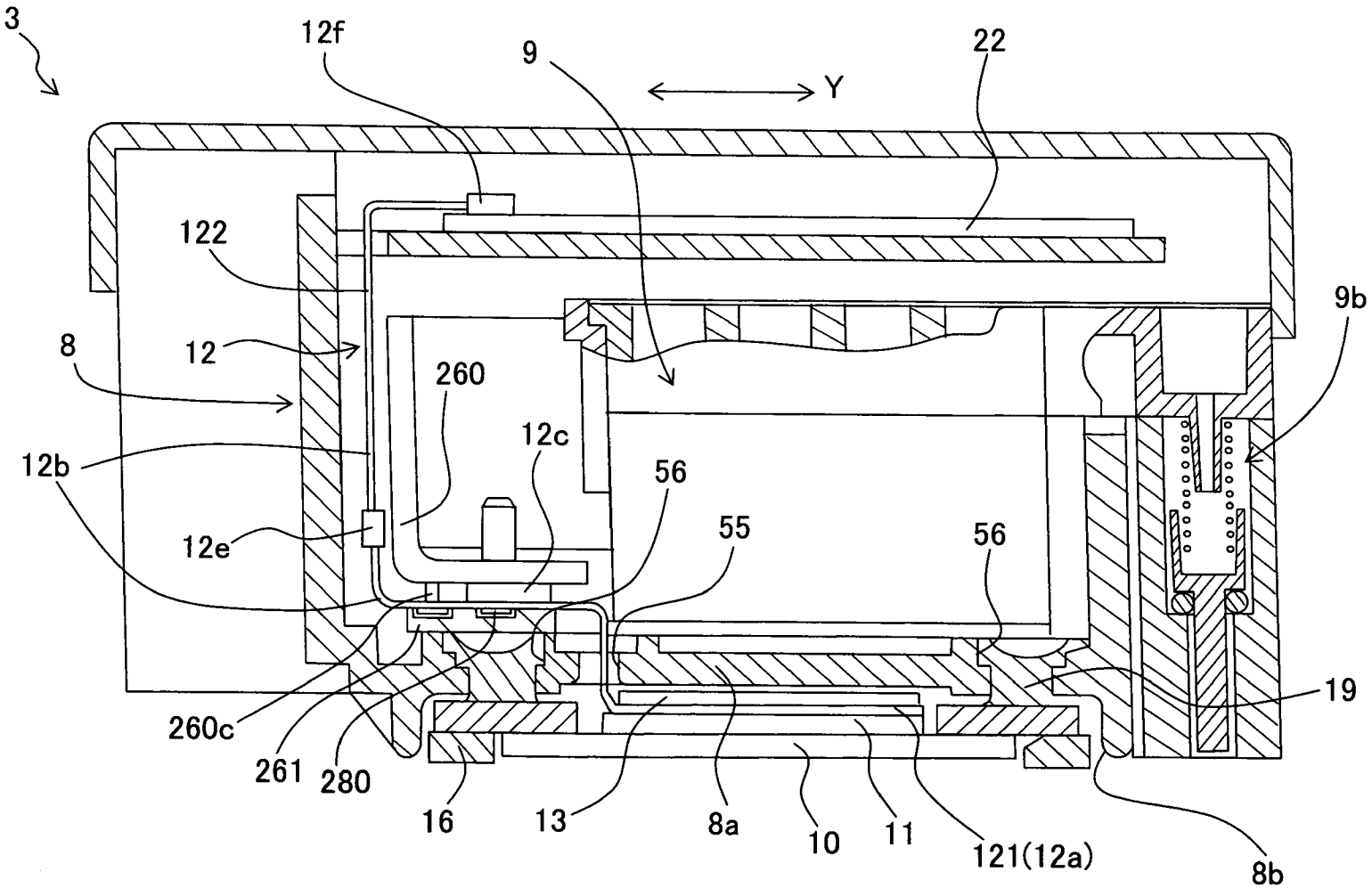
FIG. 13 is a diagram corresponding to FIG. 3 according to a third embodiment.
Figure 14:
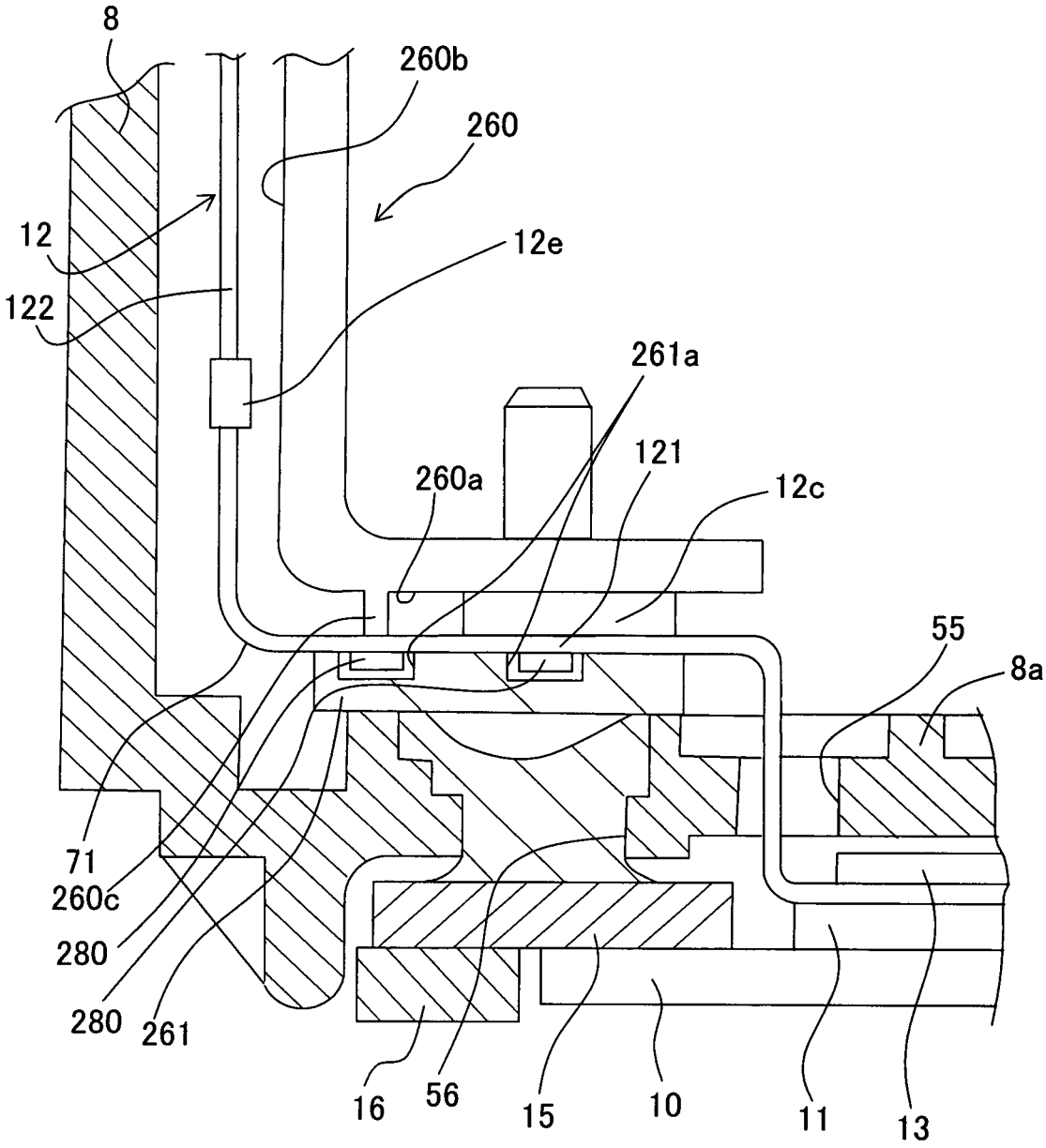
FIG. 14 is a diagram corresponding to FIG. 5 according to the third embodiment.

Next, a third embodiment of the recording apparatus according to the present invention will be described below. A recording apparatus of the third embodiment is structured similarly as the recording apparatus of the first embodiment, except for the flexible flat cable, the heat sink, and the elastic member. Therefore, a description of a portion excluding the flexible flat cable, the heat sink, and the elastic member will be omitted. As shown in FIGS. 13 and 14, in the third embodiment, an elastic member 261 is formed as a block which is formed of a resin or rubber having elasticity but no conductivity. Moreover, the elastic member 261 is fixed on the bottom plate 8*a* of the head holder by an adhesive. The elastic member 261 may also be a solid block or a porous block. An area of an upper surface (surface on a side of the flexible flat cable 12) of the elastic member 261 is wider than an area of the driving IC chip 12*c*, and almost same as an area of a contact surface 260*a* of a heat sink 260. The elastic member 261 is provided to face a part or an entire portion of the circuit element 80 mounted on a lower surface of the flexible flat cable 12. Moreover, a recess 261*a* which accommodates the circuit element 80 is formed in the elastic member 261, at a position facing the circuit element 80. Consequently, even when the circuit element 80 is projected (protruded) toward the elastic member 261, a force, which is exerted by the elastic member 261 to press the driving IC chip 12*c* of the flexible flat cable 12 against the heat sink 260, becomes uniform, and it is possible to let the driving IC chip 12*c* make a close contact with the heat sink 260 assuredly.

Moreover, in the third embodiment, the flexible portion 12*b* of the flexible flat cable 12 is drawn around by bending at substantially right angles, along both of a guiding surface 260*b* and the contact surface 260*a* of the heat sink 260. As shown in FIG. 14, when a circuit element 280 is mounted on a rear surface of an area between a bending position 71 of the flexible portion 212*b*, and an end portion 72 of a mounting position in the flexible portion 12*b*, at which the driving IC chip 12*c* is mounted, a projection (protrusion) 260*c* is projected from the contact surface 260*a* of the heat sink 260, toward a part of the flexible portion 212*b* on which the circuit element 280 is mounted.

Accordingly, when the flexible portion 212*b* is drawn along the guiding surface 260*b* by bending at the bending position 71, it is possible to regulate (restrict) a displacement of the circuit element 280 toward the heat sink 260. Therefore, it is possible to prevent the circuit element 280 from getting out of the recess 261*a*. Moreover, the flexible flat cable 12 is prevented from being lifted up from the elastic member 261 with the bending of the flexible portion 212*b*, and it is possible for the elastic member 261 to press the driving IC chip 12*c* uniformly.

Figure 15:
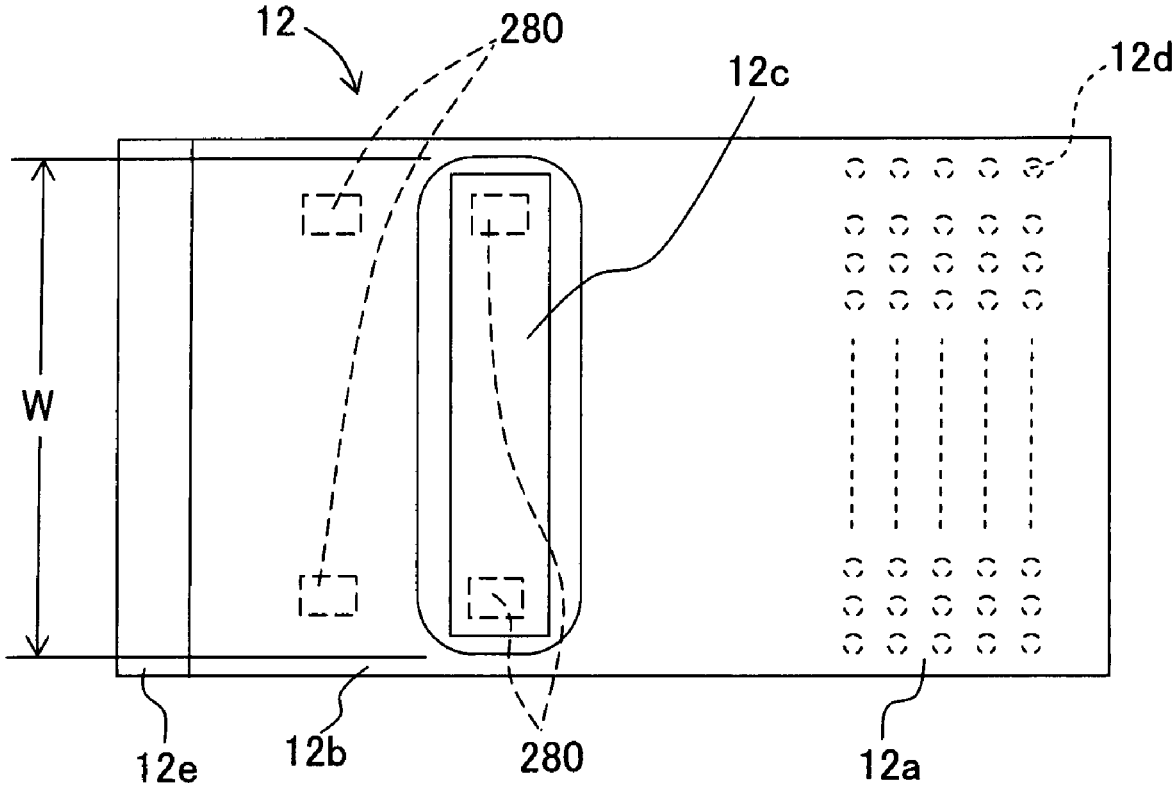
FIG. 15 is a diagram corresponding to FIG. 6 according to the third embodiment.

Moreover, in the third embodiment, it is possible to mount the circuit element 280 at an area on a rear surface of the flexible flat cable 12, on which the driving IC chip 12*c* is mounted, or the elastic member 261 is arranged. Therefore, as shown in FIG. 15, it is possible to arrange the circuit element 280 in a range of the width W of the driving IC chip 12*c*. Consequently, it is possible to facilitate a saving of space and a cost reduction by making narrow the width of the flexible flat cable 12.

Figure 16:
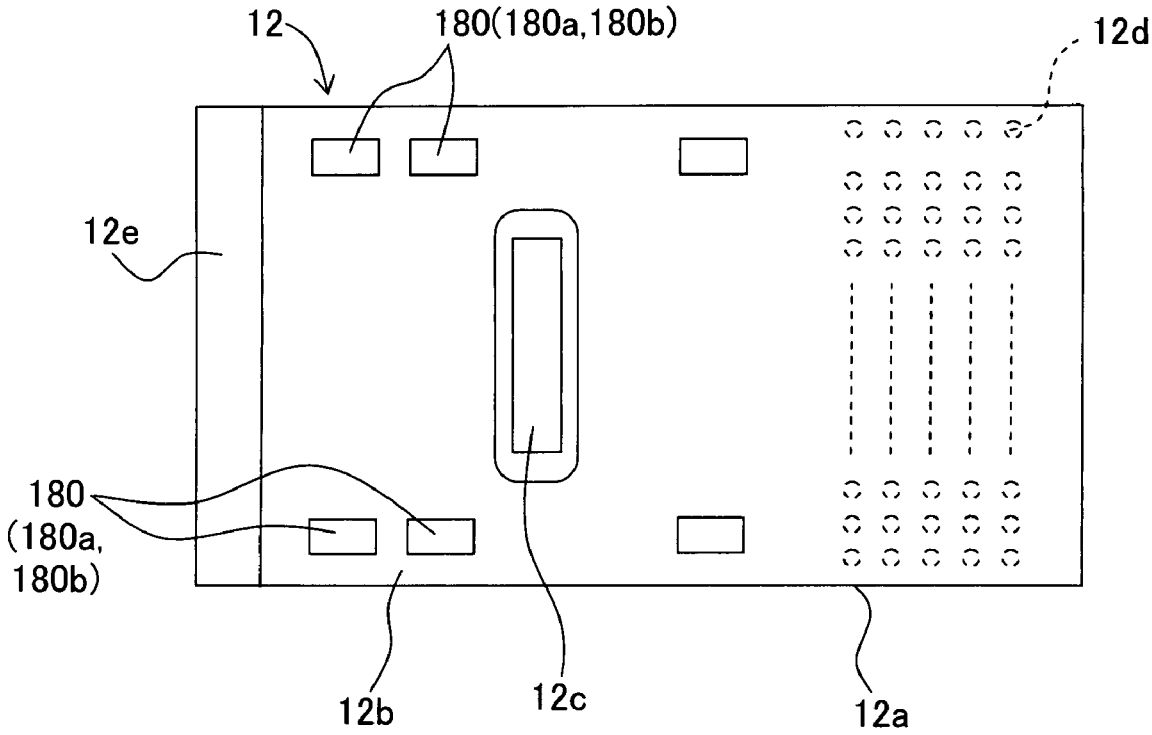
FIG. 16 is a diagram corresponding to FIG. 6 according to the second embodiment.

Practically, the drive lines VDD1 and VDD2, the ground lines VSS1 and VSS2, the common electric potential wire COM, shown in FIG. 9, are formed symmetrically along edges of both sides of the first cable 121 parallel to a direction, in which the first cable 121 is drawn from the piezoelectric actuator. Therefore, the circuit elements 280 and 180 (180*a*, 180*b*) are also mounted at positions along edges of both sides thereof as shown in FIGS. 15 and 16. Moreover, since each of the lines mentioned above is drawn around toward the piezoelectric actuator, farther away from the driving IC chip on the first cable 121, it is possible to arrange the circuit element 280, 180 (180*a*, 180*b*) toward the piezoelectric actuator side, farther away from the driving IC chip 12*c*, or on the extension in the direction of width W of the driving IC chip 12*c*.

In this manner, the abovementioned effect is exhibited by mounting the condenser 80*a* and the resistor 80*b* included in the circuit elements 280 and 180 (180*a*, 180*b*) near the driving IC chip 12*c* of the flexible flat cable 12. At this time, it is possible to release the heat of the driving IC chip 12*c* assuredly while exhibiting sufficiently the effect of the circuit elements 280 and 180 (180*a*, 180*b*) by making the structure as shown in FIGS. 11, 12, and 14.

In the description mentioned above, a configuration in which the flexible flat cable 12 is inserted through the slit 55 in the head holder 8, and bent in two-step form is exemplified. However, it is not restricted to this configuration, and the present invention is applicable provided that it is a configuration in which the heat sink 60 is brought in a close contact with the driving IC chip 12*c* mounted on the flexible flat cable 12.

In the configurations in the abovementioned embodiments, examples in which the present invention is applied to the ink-jet recording apparatus have been described. However, this invention is applicable to any type of recording apparatus provided that the recording apparatus includes a plurality of recording elements and driving sections corresponding to the recording elements, such as an impact recording apparatus.

What is claimed is:

1. A recording apparatus which performs a predetermined recording on a recording medium, comprising:

a recording head which includes a plurality of recording elements and an actuator having a plurality of driving portions which drive the recording elements selectively;

a head holder which holds the recording head such that the recording elements are exposed to an outside of the head holder;

a flexible flat cable bent to have a bent portion arranged in the head holder, and having a plurality of pattern wirings which are electrically connected to the driving portions of the actuator at one ends of the pattern wirings respectively;

a driving IC chip which is mounted on a surface of the flexible flat cable, and which is connected to the pattern wirings to supply a drive-voltage signal selectively to the driving portions of the actuator;

a power supply and a signal source which are connected to the other end of the pattern wirings to supply an electric current to the driving IC chip and the recording elements; and a circuit element which is electrically connected to a first portion, of the pattern wirings, between the driving IC chip and the power supply, which is mounted on the flexible flat cable at a different portion from the bent portion, and which supplies the electric current to the driving IC chip and the recording element.

2. The recording apparatus according to claim 1, wherein the driving IC chip includes a signal converting circuit which converts a signal transmitted from the signal source to a signal corresponding to the recording elements, and a drive-voltage signal generating circuit which generates a drive-voltage signal suitable for driving of the actuator based on the converted signal by the signal converting circuit, and the power supply supplies a current, for operating the signal converting circuit and the drive-voltage signal generating circuit, to the signal converting circuit and the drive-voltage signal generating circuit; and the circuit element is electrically connected to a second portion, of the pattern wirings, between the drive-voltage signal generating circuit and the power supply, and is mounted on the flexible flat cable.

3. The recording apparatus according to claim 2, wherein the circuit element includes two elements, one of the elements being electrically connected to a third portion, of the pattern wirings, between the signal converting circuit and the power supply, and the other of the elements being electrically connected to the second portion, of the pattern wirings, between the drive-voltage signal generating circuit and the power supply; and the elements being mounted on the flexible flat cable.

4. The recording apparatus according to claim 1, wherein the circuit element is a condenser which is inserted in parallel between a pair of wires included in the pattern wirings, the pair of wires being electrically connected to the power supply.

5. The recording apparatus according to claim 1, wherein the actuator is a piezoelectric actuator, and the circuit element includes an element which discharges electric charges generated by heating and cooling upon performing polarization process for the piezoelectric actuator.

6. The recording apparatus according to claim 1, further comprising a heat sink which is provided to the head holder, and which makes a heat conductive contact with the driving IC chip;

wherein the flexible flat cable is drawn along the heat sink, and the driving IC chip and the circuit element are mounted at positions differing from the bent portion of the flexible flat cable.

7. The recording apparatus according to claim 6, wherein the head holder has a base plate on a surface which faces the recording medium and on which the recording head is attached; a slit is formed in the base plate to penetrate the base plate from the surface facing the recording medium to an opposite surface to the surface, and the flexible flat cable is wired through the slit, and the heat sink is provided on the opposite surface of the base plate; and the flexible flat cable is bent at both sides of a position at which the driving IC chip makes a contact with the heat sink.

8. The recording apparatus according to claim 7, wherein the heat sink has a contact surface which makes a contact with a surface, of the driving IC chip, parallel to the flexible flat cable, and a guiding surface which guides the flexible flat cable to a side of a rear-surface of the head holder;

the flexible flat cable has a first area drawn from the actuator to pass through the slit, a second area along the contact surface of the heat sink, and a third area along the guiding surface of the heat sink, and the first area, the second area, and the third area are defined by bending of the flexible flat cable;

the driving IC chip is mounted at a substantially central position of the second area; and the circuit element is mounted at a substantially central position between bending positions at which the flexible flat cable is bent.

9. The recording apparatus according to claim 8, wherein the contact surface of the heat sink is wide enough to cover the surface of the driving IC chip entirely; and the circuit element is mounted on the surface of the flexible flat cable on which the driving IC chip is mounted, at a position at which the circuit element does not make a contact with the heat sink.

10. The recording apparatus according to claim 1, wherein the circuit element is mounted on an opposite surface, of the flexible flat cable, opposite to the surface on which the driving IC chip is mounted.

11. The recording apparatus according to claim 1, further comprising a heat sink which makes a heat conductive contact with the driving IC chip;

wherein the circuit element is mounted on the surface of the flexible flat cable on which the driving IC chip is mounted, and a height of the circuit element is lower than that of the driving IC chip.

12. The recording apparatus according to claim 11, wherein the driving IC chip includes a signal converting circuit which converts a signal transmitted from the signal source to a signal corresponding to the recording elements, and a drive-voltage signal generating circuit which generates the drive-voltage signal suitable for driving of the actuator based on the converted signal by the signal converting circuit;

the power supply supplies a current, for operating the signal converting circuit and the drive-voltage signal generating circuit, to the signal converting circuit and the drive-voltage signal generating circuit; and the circuit element is electrically connected to a second portion, of the pattern wirings, between the drive-voltage signal generating circuit and the power supply, and is mounted on the flexible flat cable.

13. The recording apparatus according to claim 12, wherein the circuit element includes two elements, one of the elements being electrically connected to a third portion, of the pattern wirings, between the signal converting circuit and the power supply, and the other of the elements being electrically connected to the second portion, of the pattern wirings, between the drive-voltage signal generating circuit and the power supply; the elements being mounted on the flexible flat cable.

14. The recording apparatus according to claim 11, wherein the circuit element is a condenser which is inserted in parallel between a pair of wires included in the pattern wirings, the pair of wires being electrically connected to the power supply.

15. The recording apparatus according to claim 11, wherein the actuator is a piezoelectric actuator, and the circuit element includes an element which discharges electric charges generated by heating and cooling upon performing a polarization process for the piezoelectric actuator.

16. The recording apparatus according to claim 1, further comprising a heat sink which makes a heat conductive contact with the driving IC chip;

wherein the circuit element is mounted on the surface of the flexible flat cable on which the driving IC chip is mounted, and a height of the circuit element is higher than that of the driving IC chip; and a recess, which corresponds to the circuit element and which prevents the heat sink from contacting with the circuit element, is formed in the heat sink.

17. The recording apparatus according to claim 16, wherein the heat sink is arranged to face the circuit element, with a gap intervening between the heat sink and the head holder, and the flexible flat cable is inserted through the gap.

18. The recording apparatus according to claim 16, wherein the driving IC chip includes a signal converting circuit which converts a signal transmitted from the signal source to a signal corresponding to the recording elements, and a drive-voltage signal generating circuit which generates the drive-voltage signal suitable for driving of the actuator based on the converted signal by the signal converting circuit;

the power supply supplies a current, for operating the signal converting circuit and the drive-voltage signal generating circuit, to the signal converting circuit and the drive-voltage signal generating circuit; and the circuit element is electrically connected to a second portion, of the pattern wirings, between the drive-voltage signal generating circuit and the power supply, and is mounted on the flexible flat cable.

19. The recording apparatus according to claim 18, wherein the circuit element includes two elements, one of the elements being electrically connected to a third portion, of the pattern wirings, between the signal converting circuit and the power supply, and the other of the elements being electrically connected to the second portion, of the pattern wirings, between the drive-voltage signal generating circuit and the power supply; the elements being mounted on the flexible flat cable.

20. The recording apparatus according to claim 16, wherein the circuit element is a condenser which is inserted in parallel between a pair of wires included in the pattern wirings, the pair of wires being electrically connected to the power supply.

21. The recording apparatus according to claim 16, wherein the actuator is a piezoelectric actuator, and the circuit element includes an element which discharges electric charges generated by heating and cooling upon performing a polarization process for the piezoelectric actuator.

22. The recording apparatus according to claim 11, wherein the heat sink is arranged to face the circuit element, with a gap intervening between the heat sink and the head holder, and the flexible flat cable is inserted through the gap.

23. The recording apparatus according to claim 1, further comprising:

a heat sink which makes a heat conductive contact with the driving IC chip; and an elastic member in which a recess, which accommodates the circuit element, is formed at a position facing the circuit element and which presses the flexible flat cable, from a side opposite to the surface of the flexible flat cable on which the driving IC chip is mounted, to bring the driving IC chip in contact with the heat sink.

24. The recording apparatus according to claim 23, wherein the heat sink is arranged with a gap intervening between the heat sink and the head holder, and, the driving IC chip, the circuit element, and the elastic member are arranged in the gap; and the driving IC chip has a contact with the head holder to press the elastic member against the heat sink.

25. The recording apparatus according to claim 24, wherein the flexible flat cable is arranged to bend toward the side of the surface on which the driving IC chip is mounted, at a position away from the driving IC chip;

the circuit element is mounted on an opposite surface, of the flexible flat cable, opposite to the surface on which the driving IC chip is mounted, at an area between the driving IC chip and a bent portion at which the flexible flat cable is bent; and a projection which is projected toward the surface, of the flexible flat cable, on which the driving IC chip is mounted is formed on the heat sink.

26. The recording apparatus according to claim 24 wherein the head holder includes a first wall which makes a contact with the elastic member, and a second wall which is extended from the first wall in a predetermined angle;

the heat sink includes a surface facing the first wall and another surface facing the second wall;

the flexible flat cable is wired to bend along the gap;

the circuit element is mounted on an opposite surface of the flexible flat cable, opposite to the surface on which the driving IC chip is mounted, at an area between the driving IC chip and the bent portion; and a projection, which is projected toward the surface of the flexible flat cable on which the driving IC is mounted, is formed on the surface, of the heat sink, facing the first wall.

27. The recording apparatus according to claim 23, wherein the driving IC chip includes a signal converting circuit which converts a signal transmitted from the signal source, to a signal corresponding to the recording elements, and a drive-voltage signal generating circuit which generates the drive-voltage signal suitable for driving the actuator based on the signal converted by the signal converting circuit;

the power supply supplies a current, for operating the signal converting circuit and the drive-voltage signal generating circuit, to the signal converting circuit and the drive-voltage signal generating circuit; and the circuit element is electrically connected to a second portion, of the pattern wirings, between the drive-voltage signal generating circuit and the power supply, and is mounted on the flexible flat cable.

28. The recording apparatus according to claim 27, wherein the circuit element includes two elements, one of the elements being electrically connected to a third portion, of the pattern wirings, between the signal converting circuit and the power supply, and the other of the elements being electrically connected to the second portion, of the pattern wirings, between the drive-voltage signal generating circuit and the power supply; the elements being mounted on the flexible flat cable.

29. The recording apparatus according to claim 23, wherein the circuit element is a condenser which is inserted in parallel between a pair of wires included in the pattern wirings, the pair of wires being electrically connected to the power supply.

30. The recording apparatus according to claim 23, wherein the actuator is a piezoelectric actuator, and the circuit element includes an element which discharges electric charges generated by heating and cooling upon performing a polarization process for the piezoelectric actuator.

31. A method for producing a recording apparatus which perform a predetermined recording on a recording medium, the method comprising:

providing a recording head which includes a plurality of recording elements and an actuator having a plurality of driving portions which drive selectively the recording elements;

providing a head holder which holds the recording head such that the recording elements are exposed to an outside of the head holder;

providing a flexible flat cable bent to have a bent portion arranged in the head holder, and having a plurality of pattern wirings which are electrically connected to the driving portions of the actuator at one ends of the pattern wirings respectively;

providing a driving IC chip which is mounted on a surface of the flexible flat cable, and which is connected to the pattern wires to supply a drive-voltage signal selectively to the driving portions of the actuator;

providing a power supply and a signal source which are connected to the other ends of the pattern wirings to supply electric current to the driving IC chip and the recording elements;

providing a circuit element which supplies the electric current to the driving IC chip and the recording element;

mounting the circuit element on the flexible flat cable so as to avoid the bent portion; and connecting the circuit element electrically to a portion, of the pattern wirings, between the driving IC chip and the power supply.

* * * * *